US010535287B2

(12) United States Patent
Wang et al.

(10) Patent No.: US 10,535,287 B2
(45) Date of Patent: Jan. 14, 2020

(54) STEP-DOWN PIXEL RESPONSE CORRECTION SYSTEMS AND METHODS

(71) Applicant: Apple Inc., Cupertino, CA (US)

(72) Inventors: Chaohao Wang, Sunnyvale, CA (US); Lu Zhang, Cupertino, CA (US); Zhibing Ge, Sunnyvale, CA (US); Shih-Chyuan Fan Jiang, Cupertino, CA (US); Ilie Garbacea, Cupertino, CA (US); Marc Albrecht, San Francisco, CA (US); Kingsuk Brahma, San Francisco, CA (US); Hopil Bae, Sunnyvale, CA (US); Paolo Sacchetto, Cupertino, CA (US); Jie Won Ryu, Sunnyvale, CA (US); Sandro H. Pintz, Menlo Park, CA (US); Chengrui Le, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 448 days.

(21) Appl. No.: 15/275,374

(22) Filed: Sep. 24, 2016

(65) Prior Publication Data

US 2017/0243548 A1 Aug. 24, 2017

Related U.S. Application Data

(60) Provisional application No. 62/298,307, filed on Feb. 22, 2016.

(51) Int. Cl.
*G09G 3/34* (2006.01)
*G09G 3/3258* (2016.01)
(Continued)

(52) U.S. Cl.
CPC ..... *G09G 3/20* (2013.01); *G09G 2320/029* (2013.01); *G09G 2320/0233* (2013.01);
(Continued)

(58) Field of Classification Search
CPC .. G09G 3/3406; G09G 3/3258; G09G 3/3648; G09G 2310/08; G09G 2320/0626;
(Continued)

(56) References Cited

U.S. PATENT DOCUMENTS

2005/0162367 A1 7/2005 Kobayashi et al.
2014/0267370 A1 9/2014 Albrecht et al.
(Continued)

*Primary Examiner* — Yaron Cohen
(74) *Attorney, Agent, or Firm* — Fletcher Yoder, P.C.

(57) ABSTRACT

Systems and methods are provided for improving displayed image quality of an electronic display that includes a display pixel. The electronic display displays a first image frame directly after a second image frame by applying an analog electrical signal to the display pixel. To facilitate display of the first image frame, circuitry receives image data corresponding to the image frame, in which the image data includes a grayscale value that indicates target luminance of the display pixel; determines expected refresh rate of the first image frame based at least in part on actual refresh rate of the second image frame; determines a pixel response correction offset based at least in part on the expected refresh rate of the first image frame; and determines processed image data by applying the pixel response correction offset to the grayscale value, in which the processed image data indicates magnitude of the analog electrical signal.

20 Claims, 13 Drawing Sheets

(51) Int. Cl.
*G09G 3/36* (2006.01)
*G09G 3/20* (2006.01)

(52) U.S. Cl.
CPC ..... *G09G 2320/0285* (2013.01); *G09G 2320/0295* (2013.01); *G09G 2320/043* (2013.01); *G09G 2320/0626* (2013.01); *G09G 2320/0693* (2013.01); *G09G 2340/0435* (2013.01); *G09G 2360/16* (2013.01)

(58) Field of Classification Search
CPC ..... G09G 3/20; G09G 2320/0233; G09G 2320/0285; G09G 2360/16; G09G 2360/0295; G09G 2320/043; G09G 2320/0693; G09G 2340/0435; G09G 2320/029
See application file for complete search history.

(56) References Cited

U.S. PATENT DOCUMENTS

| | | | | |
|---|---|---|---|---|
| 2014/0267448 | A1* | 9/2014 | Albrecht ..... | G09G 3/3406 345/690 |
| 2015/0339994 | A1 | 11/2015 | Verbeure | |
| 2015/0348509 | A1 | 12/2015 | Verbeure et al. | |
| 2015/0379970 | A1 | 12/2015 | Albrecht et al. | |

* cited by examiner

48B

| | DESIRED LUMINANCE | PREVIOUS EXPECTED RR | PREVIOUS PRC OFFSET VALUE | PRC OFFSET VALUE |
|---|---|---|---|---|
| 130 | 10 | 30Hz | 4 | 4 |
| 132 | 10 | 60Hz | 2 | 6 |
| 134 | 10 | 15Hz | 8 | 2 |
| 136 | 20 | 30Hz | 4 | 5 |
| | ⋮ | ⋮ | ⋮ | ⋮ |

STEP-DOWN PIXEL RESPONSE CORRECTION SYSTEMS AND METHODS

CROSS-REFERENCE TO RELATED APPLICATIONS

This application is a Non-Provisional application claiming priority to U.S. Provisional Patent Application No. 62/298,307, entitled "STEP-DOWN PIXEL RESPONSE CORRECTION SYSTEMS AND METHODS," filed Feb. 22, 2016, which is herein incorporated by reference.

BACKGROUND

The present disclosure relates generally to electronic displays and, more particularly, to pixel response correction in electronic displays.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Electronic devices often use one or more electronic displays to present visual representations of information as text, still images, and/or video by displaying one or more image frames. For example, such electronic devices may include computers, mobile phones, portable media devices, tablets, televisions, virtual-reality headsets, and vehicle dashboards, among many others. To display an image frame, an electronic display may control light emission (e.g., actual luminance) from its display pixels, for example, based on image data that indicates target (e.g., desired) luminance of the display pixels. In particular, the light emission from a display pixel may depend on magnitude of analog electrical (e.g., voltage and/or current) signals supplied (e.g., applied) to the display pixel.

However, in some instances, light emission response of display pixels in different electronic displays to an analog electrical signal may vary. Moreover, light emission response of display pixels may vary based at least in part on refresh rate used by an electronic display, which, in some instances, may not be known in advance, for example, when the electronic display adaptively adjusts refresh rate. As such, even when an analog electrical signal is supplied to a display pixel based on corresponding image data, the actual luminance of the display pixel may differ from its target luminance. When perceivable, this mismatch may result in visual artifacts that affect perceived image quality of a displayed image frame.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure generally relates to improving displayed image quality of an electronic display. In some embodiments, quality of a displayed image frame is affected by perceptible visual artifacts, which may be caused by difference between perceived (e.g., actual) luminance and target (e.g., desired) luminance. Thus, by reducing difference between perceived luminance and target luminance, the likelihood of an image frame including perceptible visual artifacts and/or perceptibility of visual artifacts in the image frame may be reduced.

An electronic display may display an image frame based on digital image data, which includes grayscale values that provide a digital indication of target luminance of display pixels for display of the image frame. To improve displayed image quality, pixel response corrected image data may be generated to compensate for variations in expected light emission of display pixels. In some embodiments, the pixel response corrected image data may be generated based at least in part on refresh rate and/or display duration of an image frame.

However, in some embodiments, the refresh rate may be unknown when an image frame is initially displayed, for example, when the electronic display uses adaptive refresh rates. In such embodiments, actual refresh rate of the image frame may be unknown until a next subsequent image frame is displayed. Thus, pixel response corrected image data may be generated based at least in part on an expected refresh rate of the image frame. However, since the pixel response correction offsets that should be applied depends on the actual refresh rate, difference between perceived luminance and target luminance may increase when the expected refresh rate does not match the actual refresh rate of the image frame. In particular, perceptibility of the difference may be greater when transitioning from a higher refresh rate (e.g., 60 Hz) to a lower threshold refresh rate (e.g., 10 Hz) of the electronic display.

To help reduce perceptibility of the difference, the electronic display may implement a step-down transition technique (e.g., scheme). In some embodiments, a step-down transition technique may include transitioning from the higher refresh rate to the lower threshold refresh rate using one or more step-down refresh rates. For example, to transition from a 60 Hz (e.g., higher) refresh rate to a 10 Hz lower threshold refresh rate, the electronic display may use a 30 Hz step-down refresh rate and/or a 15 Hz step-down refresh rate.

Using a step-down transition technique, the electronic display may attempt to transition to a step down refresh before transitioning to the lower threshold refresh rate. In other words, when a directly previous image frame is displayed using the higher refresh, the electronic display may attempt to display a current image frame at a step-down refresh rate before attempting to display a repeat of the current image frame at the lower threshold refresh rate. To facilitate transitioning to the step-down refresh rate, the electronic display may display the current image frame a display duration up to a display duration threshold associated with the step-down refresh rate.

For example, the electronic display may display the directly previous image frame with a 60 Hz refresh rate when first image data corresponding to a first (e.g., current) image frame is received. Accordingly, expected refresh rate of the first image frame may be 60 Hz and, thus, corresponding pixel response corrected image data may be generated based at least in part on an expected refresh rate of 60 Hz. When second image data corresponding to a second image frame to be subsequently displayed is not yet received, the electronic display may attempt to transition to a 30 Hz step-down refresh rate. To facilitate, the electronic display may display the first image frame up to 33.33 ms (e.g., a display duration threshold associated with the 30 Hz step-down refresh rate). When display duration of the first image frame reaches 33.33 ms and the second image data still has not been received, the electronic display may display a repeat of the first image frame.

As such, the first image frame is displayed with the 30 Hz step-down refresh rate while the corresponding pixel response corrected image data was generated based at least in part on a 60 Hz expected refresh rate. Due to mismatch between actual refresh rate and expected refresh rate, average (e.g., perceived) luminance of one or more pixels used to display the first image frame may vary from target luminance. However, perceptibility of the difference may be reduced compared to other transition techniques, such as a direct transition technique that attempts to switch directly from a higher refresh rate to a lower threshold refresh rate. In some embodiments, perceptibility of the difference may be less due to smaller difference between the higher refresh rate and the step-down refresh rate and, thus, smaller difference between a pixel response correction offset determined based on the higher refresh rate and a pixel response correction determined based on the step-down refresh rate. Additionally, in some embodiments, perceptibility of the difference may be less due to shorter duration of an image frame displayed at the step-down refresh rate and/or magnitude of the difference changing more gradually (e.g., across multiple image frames).

Additionally, luminance of a display pixel may change while an image frame is displayed, for example, due to stored voltage gradually decreasing. As such, to reduce difference between perceived luminance and target luminance, pixel response corrected image data may be determined based at least in part on luminance of the display pixel when the image frame is to be displayed (e.g., at the end of a directly previous image frame). In some embodiments, luminance of the display pixel may be determined based at least in part on expected refresh rate of the directly previous image frame, actual refresh rate of the directly previous image frame, magnitude of analog electrical signals used to display the directly previous image frame, and/or polarity of the analog electrical signals used to display the directly previous image frame.

BRIEF DESCRIPTION OF THE DRAWINGS

Various aspects of this disclosure may be better understood upon reading the following detailed description and upon reference to the drawings in which.

DETAILED DESCRIPTION

Figure 1:
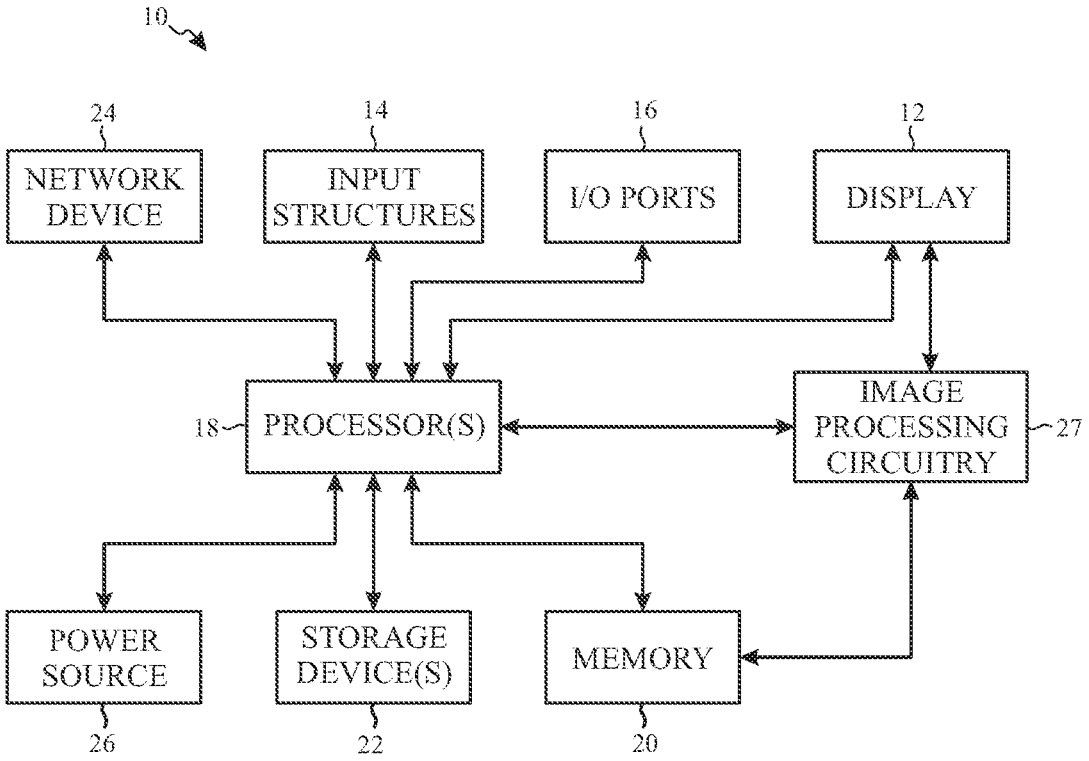
FIG. 1 is a block diagram of an electronic device used to display image frames, in accordance with an embodiment.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Generally, an electronic display may display an image frame by applying analog electrical signals (e.g., voltage and/or current) to display pixels on a display panel. In some electronic displays, the analog electrical signal supplied to a display pixel may be stored in the display pixel to control light emission and, thus, perceived (e.g., actual) luminance of the display pixel. For example, in a liquid crystal display (LCD), a voltage signal supplied to a display pixel may be stored in a pixel electrode to produce an electric field, which controls light emission from the display pixel by adjusting adjusts orientation of liquid crystals. Additionally, in an organic light-emitting diode (OLED) display, a voltage signal supplied to a display pixel may be stored in a storage capacitor, which controls control light emission from the display pixel by adjusting electrical power supplied to a self-emissive component.

However, even within the same type of electronic display, display pixels in different electronic displays may have varying light emission responses to supplied analog electrical signals. For example, supplying an analog electrical signal to a display pixel in one electronic display may result in one luminance while supplying the same analog electrical signal to a display pixel in another electronic display may result in a different luminance. Moreover, the light emission response of a display pixel to a supplied analog electrical signal may vary with refresh rate and, thus, display duration of corresponding image frames. For example, supplying an analog electrical signal to a display pixel to display a 30 Hz image frame may result in one luminance while supplying the same analog electrical signal to the display pixel to display a 120 Hz image rate may result in a different luminance.

In other words, pixel response of display pixels may affect actual luminance of the display pixels. In fact, in some instances, the pixel response may cause variation between the actual luminance and target luminance of the display pixels. When perceivable, such variations may result in visual artifacts in displayed image frames, which affect perceived image quality of an electronic display.

To facilitate improving perceived image quality, image data may be adjusted (e.g., corrected) based at least in part on expected pixel response of display pixels in an electronic display. For example, a display pipeline may receive input (e.g., gamma domain) image data and output pixel response corrected image data that compensates for the expected pixel response. In some embodiments, the display pipeline may generate the pixel response corrected image data by determining a pixel response correction (PRC) offset based at least in part on the expected pixel response and applying (e.g., adding or subtracting) the pixel response correction offset to the input image data and/or the analog electrical signal to be supplied to the display pixel. Additionally or alternatively, the display pipeline may generate the pixel response corrected image data by mapping the input image data based at last in part on the expected pixel response, for example, using one or more look-up-tables.

In some instances, pixel response of display pixels associated with display of an image frame may be affected by various operational parameters, such as display duration of the image frame, refresh rate used to display the image frame, environmental conditions (e.g., temperature) when the image frame is displayed, luminance at the end of a directly previous image frame, and/or charge accumulation caused by one or more previously displayed image frames. As such, the display pipeline may determine pixel response corrected image data to be used to display an image frame based at least in part on operational parameters expected to be present when the image frame is displayed.

In some embodiments, some of the expected operational parameters may be determinable with relative certainty when the image frame is to be initially displayed. For example, expected environmental conditions may be determined based at least in part on sensor data indicative of the environmental conditions. Additionally, expected luminance and/or expected charge accumulation of display pixels may be determined based at least in part on image data used to display one or more previous image frames. Furthermore, when operating in an auto mode, the electronic may display image frames using a constant (e.g., 60 Hz) refresh rate and, thus, a constant (e.g., 16.66 ms) display duration. As such, the expected refresh rate may be the constant (e.g., fixed) refresh rate and/or the expected display duration may be the constant (e.g., fixed display duration).

However, in some embodiments, some of the expected operational parameters may be unknown when the image frame is to be initially displayed. For example, when operating in a normal mode, the electronic display may dynamically adjust the refresh rate and, thus, the display duration of image frames based on various factors. In some embodiments, to facilitate reducing power consumption, the electronic display may reduce refresh rate and, thus, increase display duration of image frames. On the other hand, to facilitate improving perceived image quality, the controller may instruct the electronic display may increase refresh rate and, thus, reduce display duration of image frames, for example, to reduce motion blur.

Additionally, in some embodiments, the electronic display may adjust refresh rate based at least in part on when image data corresponding with subsequent image frames are received. For example, the electronic display may display a first image frame when corresponding first image data is received. Additionally, the electronic display may continue displaying the first image frame and/or repeats of the first image frame until second image data corresponding to a second image frame is received. When the first image frame and/or repeats of the first image frame are displayed, the perceived visual representation is constant, thereby enabling the electronic display to reduce refresh rate and, thus, power consumption.

However, in such embodiments, the electronic display may not be able to determine for certain when image data corresponding to a subsequent image frame will be received. In other words, actual refresh rate and/or display duration of an image frame may be unknown when the image frame is initially displayed. Thus, in some embodiments, the expected refresh rate and/or expected display duration used to determine pixel response corrected image data may be predicted, for example, based at least in part on refresh rate and/or display duration of one or more previous image frames.

As described above, pixel response may vary based at least in part on refresh rate and/or display duration of a corresponding image frame. Thus, to facilitate achieving the target luminance, the pixel response corrected image data used to display an image frame may vary based at least in part on the refresh rate and/or display duration of the image frame. For example, magnitude of the pixel response correction offset applied to display an image frame using a 10 Hz refresh rate may be greater than magnitude of the pixel response correction offset applied to display the image frame using a 60 Hz refresh rate to account for the longer display duration.

Thus, when the actual refresh rate and the predicted (e.g., expected) refresh rate differ, the perceived luminance may perceivably vary from the target luminance, thereby resulting in visual artifacts in the displayed image frame. For example, when a 60 Hz pixel response correction offset is applied, but the image frame is actually displayed with the 10 Hz refresh rate, perceived luminance of a display pixel may be less than the target luminance because magnitude of the 60 Hz pixel response correction offset is insufficient to compensate for the voltage decrease of the display pixel. On the other hand, when a 10 Hz pixel response correction offset is applied, but the image frame is actually displayed with the 60 Hz refresh rate, perceived luminance of the display pixel may be greater than the target luminance because magnitude of the 10 Hz pixel response correction offset overcompensates for the voltage decrease of the display pixel.

Accordingly, the present disclosure provides techniques for improving perceived image quality of an electronic display by reducing likelihood of perceivable visual artifacts caused by variations in display pixel light emission response—particularly when the electronic display uses adaptive (e.g., dynamic) refresh rates. In some embodiments, a step-down transition technique (e.g., scheme) may be implemented, in which the electronic display uses one or more step-down refresh rates to transition from a higher refresh rate to a lower (e.g., lower threshold) refresh rate. In a specific, non-limiting, example, a display pipeline may receive first image data corresponding to a first image frame and generate first pixel response corrected image data used by the electronic display to display the first image frame. Approximately 16.67 ms later, the display pipeline may receive second image data corresponding to a second image frame and generate second pixel response corrected image data used by the electronic display to overwrite the first image frame with the second image frame. As such, the first image frame may be displayed with a 60 Hz refresh rate. Since the first image frame is displayed with a 60 Hz refresh rate, the display pipeline may predict that the second image frame will also have a 60 Hz refresh rate and, thus, generate the second pixel response corrected image data based at least in part on an expected refresh rate of 60 Hz.

After the second image frame is displayed, the electronic display may wait for third image data corresponding to a third image frame to be subsequently displayed. While waiting, the electronic display may continue displaying the visual representation of the second image frame, for example, by displaying the second image frame and/or repeats of the second image frame. As described above, the electronic display may reduce refresh rate to facilitate reducing power consumption. In some embodiments, the electronic display may be capable of displaying image frames using multiple different refresh rates from a lower threshold refresh rate (e.g., 10 Hz) to an upper threshold refresh rate (e.g., 120 Hz or 240 Hz).

Accordingly, when the visual representation displayed is constant (e.g., by displaying the second image frame and repeats of the second image frame), the electronic display may reduce power consumption by reducing its refresh rate down to the lower threshold refresh rate. However, reducing directly from a higher refresh rate to the lower threshold refresh rate may increase perceptibility of variations between perceived luminance and target luminance. As will be described in more detail below, in some embodiments, the perceptibility of the variations may result from larger difference between magnitude of a pixel response correction offset determined based on the higher refresh rate (e.g., predicted/expected refresh rate) and a pixel response correction offset determined based on the lower threshold refresh rate (e.g., actual refresh rate).

To facilitate reducing perceptibility of the variations, the electronic display may implement a step-down transition technique to gradually transition the refresh rate from the higher refresh rate to the lower threshold refresh rate using one or more step-down refresh rates. For example, the step-down refresh rates may include a 30 Hz step-down refresh rate and a 15 Hz step-down refresh rate. Using these step-down refresh rates, continuing with the above example, the electronic display may continue displaying the second image frame until display duration reaches a step-down frame duration threshold associated with the 30 Hz step-down refresh rate (e.g., 33.33 ms). Subsequently, the electronic display may overwrite the second image frame with a first repeat of the second image frame based at least in part on third pixel response corrected image data. As such, the second image frame may be displayed with the 30 Hz step-down refresh rate. Since the second image frame is displayed with the 30 Hz step-down refresh rate, the display pipeline may predict that the first repeat of the second image frame will also have a 30 Hz refresh rate and, thus, generate the third pixel response corrected image data based at least in part on an expected refresh rate of 30 Hz.

The electronic display may continue displaying the first repeat of the second image frame until display duration reaches a step-down duration threshold associated with the 15 Hz step-down refresh rate (e.g., 66.67 ms). Subsequently, the electronic display may overwrite the first repeat of the second image frame with a second repeat of the second image frame based at least in part on fourth pixel response corrected image data. As such, the first repeat of the second image frame may be displayed with the 15 Hz step-down refresh rate. Since the first repeat of the second image frame is displayed with the 15 Hz step-down refresh rate, the display pipeline may predict that the second repeat of the second image frame will also have a 15 Hz refresh rate and, thus, generate the fourth pixel response corrected image data based at least in part on an expected refresh rate of 15 Hz.

The electronic display may continue displaying the second repeat of the second image frame until display duration reaches a lower threshold frame duration threshold associated with the 10 Hz lower threshold refresh rate (e.g., 10 ms). Subsequently, the electronic display may overwrite the second repeat of the second image frame with a third repeat of the second image frame. As such, the second repeat of the second image frame may be displayed with a 10 Hz lower threshold refresh rate.

Once the lower threshold refresh rate is reached, the electronic display may continue displaying repeats of the second image frame at the lower threshold refresh rate until the third image data is received. For example, the electronic display may continue displaying the third repeat of the second image frame until display duration reaches the lower threshold frame duration threshold and subsequently overwrite the third repeat of the second image frame with a fourth repeat of the second image frame. As such, the third repeat of the second image frame may be displayed with the 10 Hz lower threshold refresh rate. Additionally, the electronic display may continue displaying the fourth repeat of the second image frame until display duration reaches approximately the lower threshold frame duration threshold, subsequently overwrite the fourth repeat of the second image frame with a fifth repeat of the second image frame, and so on. As such, the fourth repeat of the second image frame may be displayed with the 10 Hz lower threshold refresh rate.

In other embodiments, the electronic display may display an image frame up to a display duration threshold associated with its expected refresh rate. For example, the electronic display may continue displaying the second image frame until display duration reaches a display duration threshold associated with its 60 Hz expected refresh rate (e.g., 16.67 ms). In such embodiments, the expected refresh rate of each repeat frame may be equal to a next step-down refresh rate. For example, the electronic display may overwrite the second image frame with a first repeat of the second image frame with a 30 Hz expected refresh rate and continue displaying the first repeat of the second image until display duration reaches a display duration associated with its 30 Hz expected refresh rate (e.g., 33.33 ms). Additionally, the electronic display may overwrite the first repeat of the second image frame with a second repeat of the second image frame with a 15 Hz expected refresh rate and continue displaying the second repeat of the second image until display duration reaches a display duration associated with its 15 Hz expected refresh rate (e.g., 66.67 ms).

As described above, to reduce perceptibility of variations between perceived luminance and target luminance, value of a pixel response correction offset may increase as display duration of an image frame increases and/or refresh rate decreases. Thus, effectiveness of a pixel response correction offset may be based at least in part on difference between the expected (e.g., predicted) refresh rate used to determine the pixel response corrected image data and the actual refresh rate of an image frame. For example, magnitude of a 10 Hz pixel response correction offset may be closer to magnitude of a 30 Hz pixel response correction offset than a 60 Hz pixel response correction offset. As such, applying a 30 Hz pixel response correction offset to display an image frame with a 10 Hz refresh rate may cause less perceptible variations compared to applying a 60 Hz pixel response.

Thus, by using one or more step-down refresh rates (e.g., 30 Hz), the electronic display may reduce difference between expected refresh rate and an actual refresh rate and, thus, variations between perceived luminance and target luminance. In other words, a step-down transition technique may artificially implement frame boundaries between an image frame and repeats of the image frame to gradually transition from a higher refresh rate (e.g., 60 Hz) to a lower threshold refresh rate (e.g., 10 Hz). In this manner, the step-down transition technique may facilitate to reducing perceptibility of variations between perceived luminance and target luminance of image frames.

Moreover, implementing a step-down transition technique may still enable the electronic display to immediately exit when image data corresponding to a subsequent image frame is received. To help illustrate, continuing with the above example, the electronic display may overwrite the second image frame or a repeat of the second image frame with the third image frame at any time after the third image data is received. However, as described above, the magnitude of the analog electrical signal stored in a display pixel and, thus, luminance of the display pixel may gradually decrease the longer an image frame is displayed. In other words, the luminance of the display pixel may vary during the display of the image frame.

Accordingly, to facilitate reducing perceptibility of variation from target luminance, the electronic display may determine the magnitude pixel response corrected image data based at least in part on luminance of a display pixel at the end of a previous image frame (e.g., when the electronic display begins writing a current image frame to the display pixel). In some embodiments, the electronic display may determine luminance of the display pixel at the end of the previous image frame based at least in part on actual refresh rate/display duration of the previous image frame, expected refresh rate/display duration of the previous image frame, and/or pixel response correction offset values applied to display the previous image frame. Thus, in such embodiments, the electronic display may determine the pixel response correction offset used to display the current image frame based at least in part on expected refresh rate/display duration of the previous image frame, the actual refresh rate/display duration of the previous image frame, and/or the pixel response correction offset values applied to display the previous image frame.

To help illustrate, an electronic device 10 including an electronic display 12 is shown in FIG. 1. As will be described in more detail below, the electronic device 10 may be any suitable electronic device, such as a computer, a mobile phone, a portable media device, a tablet, a television, a virtual-reality headset, a vehicle dashboard, and the like. Thus, it should be noted that FIG. 1 is merely one example of a particular implementation and is intended to illustrate the types of components that may be present in an electronic device 10.

In the depicted embodiment, the electronic device 10 includes the electronic display 12, one or more input structures 14, one or more input/output (I/O) ports 16, a processor core complex 18 having one or more processor(s) or processor cores, local memory 20, a main memory storage device 22, a network interface 24, a power source 26, and image processing circuitry 27. The various components described in FIG. 1 may include hardware elements (e.g., circuitry), software elements (e.g., a tangible, non-transitory computer-readable medium storing instructions), or a combination of both hardware and software elements. It should be noted that the various depicted components may be combined into fewer components or separated into additional components. For example, the local memory 20 and the main memory storage device 22 may be included in a single component. Additionally, the image processing circuitry 27 (e.g., a graphics processing unit) may be included in the processor core complex 18.

As depicted, the processor core complex 18 is operably coupled with local memory 20 and the main memory storage device 22. Thus, the processor core complex 18 may execute instruction stored in local memory 20 and/or the main memory storage device 22 to perform operations, such as generating and/or transmitting image data. As such, the processor core complex 18 may include one or more general purpose microprocessors, one or more application specific processors (ASICs), one or more field programmable logic arrays (FPGAs), or any combination thereof.

In addition to instructions, the local memory 20 and/or the main memory storage device 22 may store data to be processed by the processor core complex 18. Thus, in some embodiments, the local memory 20 and/or the main memory storage device 22 may include one or more tangible, non-transitory, computer-readable mediums. For example, the local memory 20 may include random access memory (RAM) and the main memory storage device 22 may include read only memory (ROM), rewritable non-volatile memory such as flash memory, hard drives, optical discs, and/or the like.

As depicted, the processor core complex 18 is also operably coupled with the network interface 24. In some embodiments, the network interface 24 may facilitate communicating data with another electronic device and/or a network. For example, the network interface 24 (e.g., a radio frequency system) may enable the electronic device 10 to communicatively couple to a personal area network (PAN), such as a Bluetooth network, a local area network (LAN), such as an 802.11x Wi-Fi network, and/or a wide area network (WAN), such as a 4G or LTE cellular network.

Additionally, as depicted, the processor core complex 18 is operably coupled to the power source 26. In some embodiments, the power source 26 may provide electrical power to one or more component in the electronic device 10, such as the processor core complex 18 and/or the electronic display 12. Thus, the power source 26 may include any suitable source of energy, such as a rechargeable lithium polymer (Li-poly) battery and/or an alternating current (AC) power converter.

Furthermore, as depicted, the processor core complex 18 is operably coupled with the one or more I/O ports 16. In some embodiments, an I/O ports 16 may enable the electronic device 10 to interface with other electronic devices. For example, when a portable storage device is connected, the I/O port 16 may enable the processor core complex 18 to communicate data with the portable storage device.

As depicted, the electronic device 10 is also operably coupled with the one or more input structures 14. In some embodiments, an input structures 14 may facilitate user interaction with the electronic device 10, for example, by receiving user inputs. Thus, an input structure 14 may include a button, a keyboard, a mouse, a trackpad, and/or the like. Additionally, in some embodiments, an input structure 14 may include touch-sensing components in the electronic display 12. In such embodiments, the touch sensing components may receive user inputs by detecting occurrence and/or position of an object touching the surface of the electronic display 12.

In addition to enabling user inputs, the electronic display 12 may include a display panel with one or more display pixels. As described above, the electronic display 12 may control light emission from the display pixels to present visual representations of information, such as a graphical user interface (GUI) of an operating system, an application interface, a still image, or video content, by displaying image frames based at least in part on corresponding image data. As depicted, the electronic display 12 is operably coupled to the processor core complex 18 and the image processing circuitry 27. In this manner, the electronic display 12 may display image frames based at least in part on image data generated by the processor core complex 18, the image processing circuitry 27. Additionally or alternatively, the electronic display 12 may display image frames based at least in part on image data received via the network interface 24, an input structure, and/or an I/O port 16.

Figure 2:
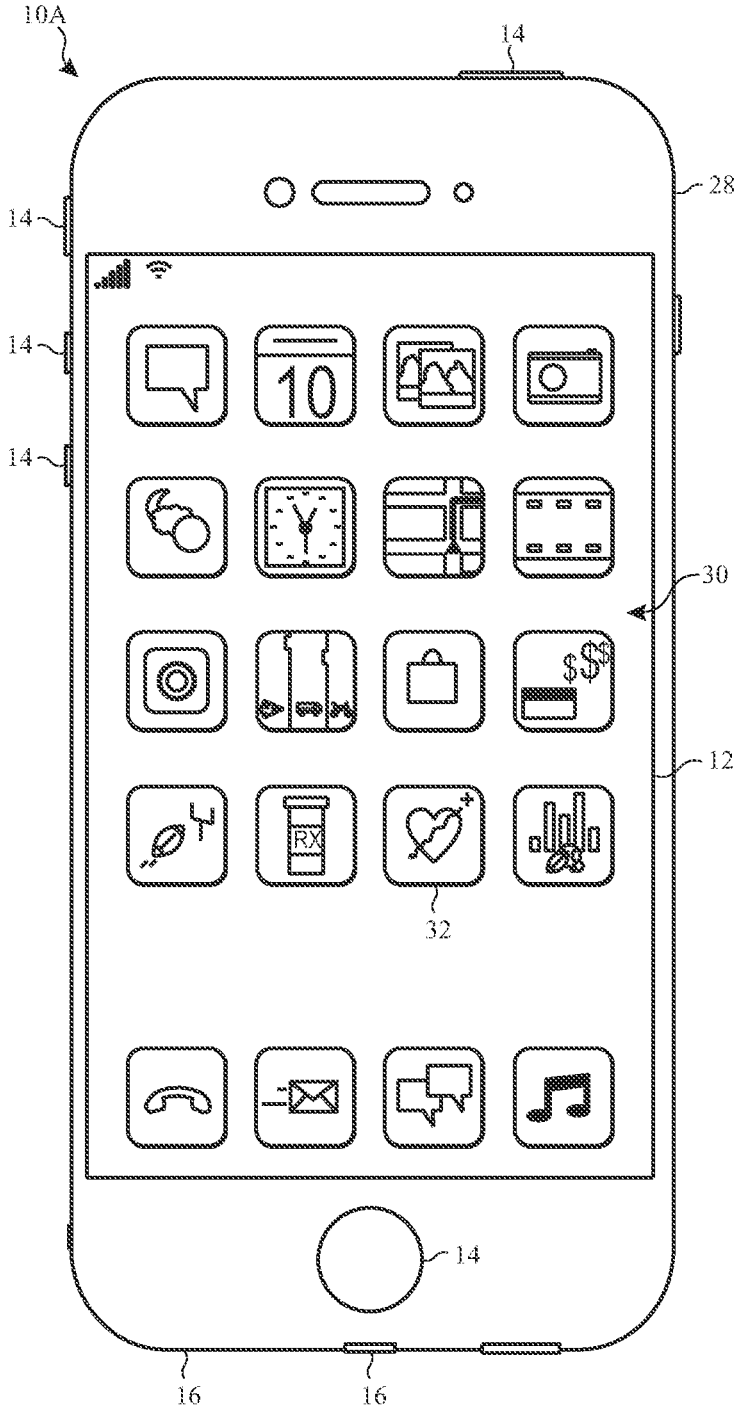
FIG. 2 is an example of the electronic device of FIG. 1, in accordance with an embodiment.

As described above, the electronic device 10 may be any suitable electronic device. To help illustrate, one example of a suitable electronic device 10, specifically a handheld device 10A, is shown in FIG. 2. In some embodiments, the handheld device 10A may be a portable phone, a media player, a personal data organizer, a handheld game platform, and/or the like. For illustrative purposes, the handheld device 10A may be a smart phone, such as any iPhone® model available from Apple Inc.

As depicted, the handheld device 10A includes an enclosure 28 (e.g., housing). In some embodiments, the enclosure 28 may protect interior components from physical damage and/or shield them from electromagnetic interference. Additionally, as depicted, the enclosure 28 surrounds the electronic display 12. In the depicted embodiment, the electronic display 12 is displaying a graphical user interface (GUI) 30 having an array of icons 32. By way of example, when an icon 32 is selected either by an input structure 14 or a touch-sensing component of the electronic display 12, an application program may launch.

Furthermore, as depicted, input structures 14 open through the enclosure 28. As described above, the input structures 14 may enable a user to interact with the handheld device 10A. For example, the input structures 14 may enable the user to activate or deactivate the handheld device 10A, navigate a user interface to a home screen, navigate a user interface to a user-configurable application screen, activate a voice-recognition feature, provide volume control, and/or toggle between vibrate and ring modes. As depicted, the I/O ports 16 also open through the enclosure 28. In some embodiments, the I/O ports 16 may include, for example, an audio jack to connect to external devices.

Figure 3:
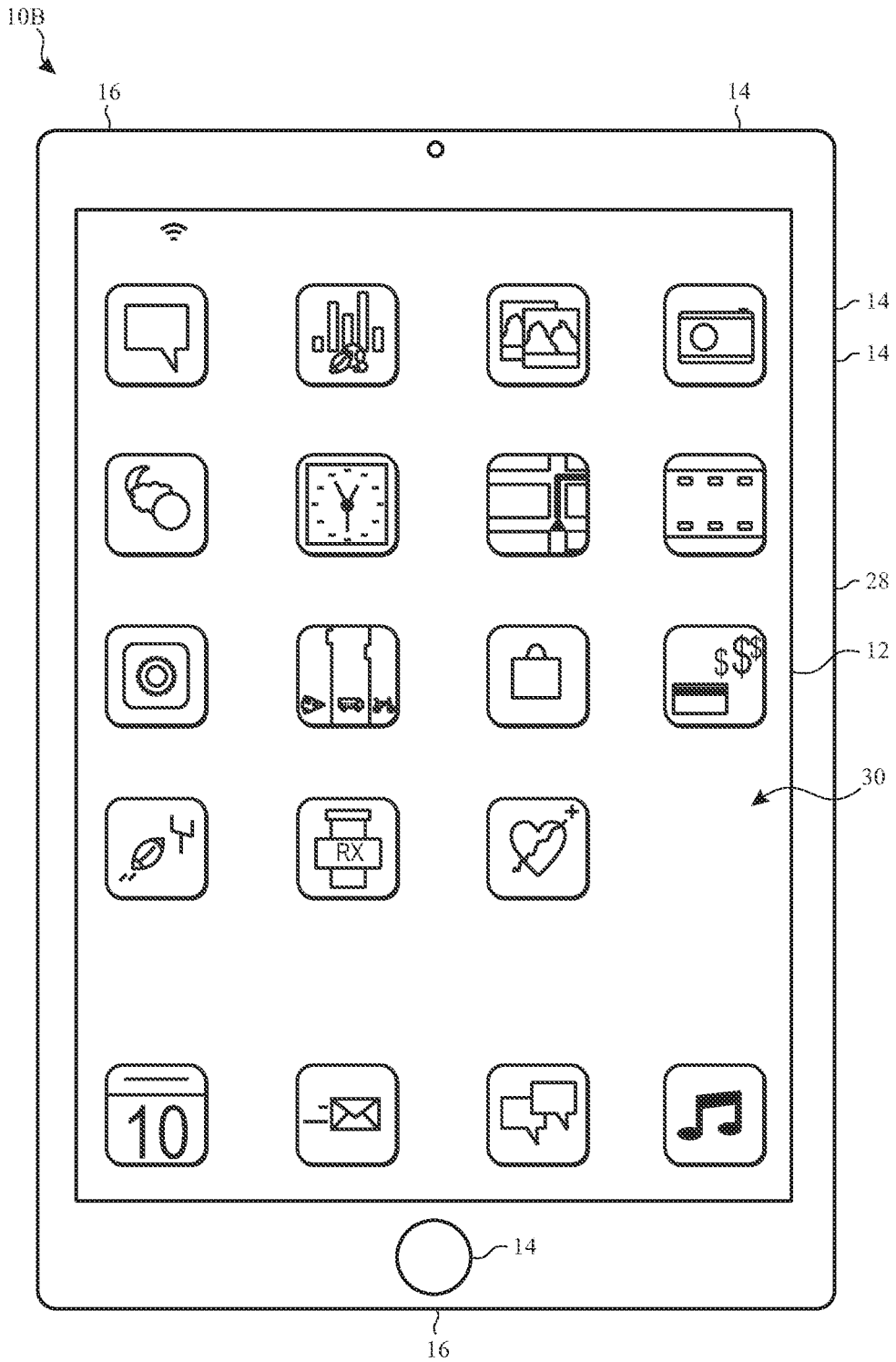
FIG. 3 is an example of the electronic device of FIG. 1, in accordance with an embodiment.
Figure 4:
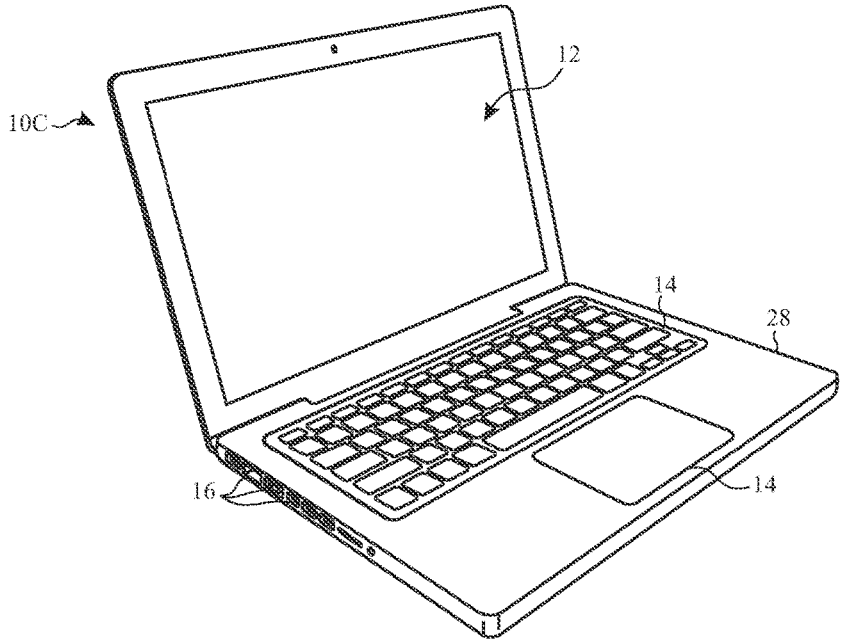
FIG. 4 is an example of the electronic device of FIG. 1, in accordance with an embodiment.

To further illustrate, another example of a suitable electronic device 10, specifically a tablet device 10B, is shown in FIG. 3. For illustrative purposes, the tablet device 10B may be any iPad® model available from Apple Inc. A further example of a suitable electronic device 10, specifically a computer 10C, is shown in FIG. 4. For illustrative purposes, the computer 10C may be any Macbook® or iMac® model available from Apple Inc. As depicted, the tablet device 10B and the computer 10C may each also include an electronic display 12, input structures 14, I/O ports 16, an enclosure 28, or any combination thereof.

As described above, the electronic display 12 may display image frames based on image data received, for example, from the processor core complex 18 and/or the image processing circuitry 27. In some embodiments, a display pipeline may analyze the image data, for example, to determine target luminance (e.g., grayscale level) of display pixels for displaying a corresponding image frame on the electronic display 12. Additionally, in some embodiments, the display pipeline may process the image data based at least in part on the analysis, for example, to determine pixel response corrected image data that compensates for expected pixel response of display pixels in the electronic display 12.

Figure 5:
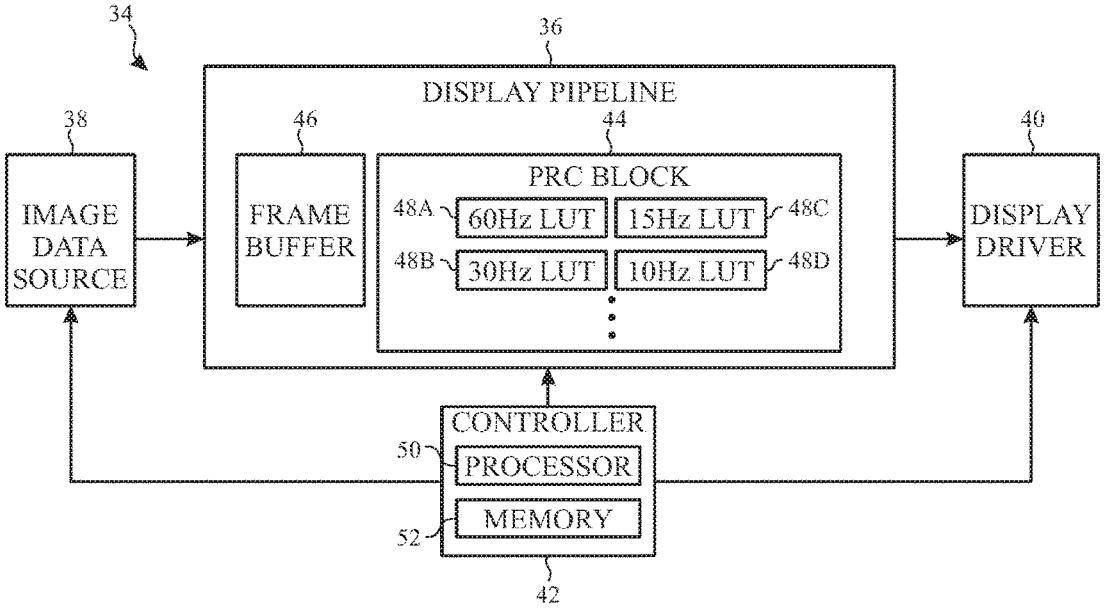
FIG. 5 is block diagram of a portion of the electronic device of FIG. 1 used to display image frames, in accordance with an embodiment.

To help illustrate, a portion 34 of the electronic device 10 including a display pipeline 36 is described in FIG. 5 In some embodiments, the display pipeline 36 may be implemented by in the electronic device 10, the electronic display 12, or a combination thereof. For example, the display pipeline 36 may be included in the processor core complex 18, the image processing circuitry 27, a timing controller (TCON) in the electronic display 12, other one or more processing units, other processing circuitry, or any combination thereof.

As depicted, the portion 34 of the electronic device 10 also includes an image data source 38, a display driver 40, and a controller 42. In some embodiments, the controller 42 may control operation of the display pipeline 36, the image data source 38, and/or the display driver 40. To facilitate controlling operation, the controller 42 may include a controller processor 50 and controller memory 52. In some embodiments, the controller processor 50 may execute instructions stored in the controller memory 52. Thus, in some embodiments, the controller processor 50 may be included in the processor core complex 18, the image processing circuitry 27, a timing controller in the electronic display 12, a separate processing unit, separate processing circuitry, or any combination thereof. Additionally, in some embodiments, the controller memory 52 may be included in the local memory 20, the main memory storage device 22, a separate tangible, non-transitory, computer readable medium, or any combination thereof.

In the depicted embodiment, the display pipeline 36 is communicatively coupled to the image data source 38. In this manner, the display pipeline 36 may receive image data from the image data source 38. As described above, in some embodiments, the image data source 38 may be included in the processor core complex 18, the image processing circuitry 27, or a combination thereof.

Additionally, in the depicted embodiment, the display pipeline 36 is communicatively coupled to the display driver 40. In this manner, the display driver 40 may receive image data from the display pipeline 36 and write image frames to a display panel based at least in part on the received image data. To write an image frame, the display driver 40 may supply analog electrical (e.g., voltage or current) signals to display pixels on the display panel. In this manner, the display pixels may control light emission based at least in part on received analog electrical signals to facilitate displaying the image frame on the electronic display 12.

To facilitate improving perceived image quality, the display pipeline 36 may analyze and/or process the image data before displaying a corresponding image frame. To facilitate analyzing and/or processing image data, the display pipeline 36 may include a frame buffer 46 used to store image data. In some embodiments, the frame buffer 46 may store image data received from the image data source 38, image data to be processed, image data already processed by the display pipeline 36, and/or image data to be supplied to the display driver 40. For example, the frame buffer 46 may store image data corresponding to one or more previous image frames, a current image frame, one or more subsequent image frames, or any combination thereof.

Additionally, the display pipeline 36 may include one or more image data processing blocks that operate to analyze and/or process image data. For example, in the depicted embodiment, the image data processing blocks include a pixel response correction (PRC) block 44. Additionally, in some embodiments, the image data processing blocks may include a gamma convert block, an ambient adaptive pixel (AAP) block, a dynamic pixel backlight (DPB) block, a white point correction (WPC) block, a sub-pixel layout compensation (SPLC) block, a burn-in compensation (BIC) block, a panel response correction (PRC) block, a dithering block, a sub-pixel uniformity compensation (SPUC) block, a content frame dependent duration (CDFD) block, an ambient light sensing (ALS) block, or any combination thereof.

As described above, display pixels in different electronic displays 12 and, thus, different display panels may have varying light emission responses to supplied analog electrical signals. Moreover, in some embodiments, light emission response of display pixels on a display panel may be affected by operational parameters, such as refresh rate, display duration, environmental conditions, polarity of supplied analog electrical signal, charge accumulation caused by one or more previously displayed image frames, and/or backlight luminance. In some instances, variations in pixel response may result in actual luminance of display pixels differing from their target luminance, which may be perceivable as visual artifacts on displayed image frames.

To facilitate improving perceived image quality, the pixel response correction block 44 may adjust image data to compensate for the expected pixel response of the display pixels. In particular, the pixel response correction block 44 may convert input (e.g., gamma domain) image data into pixel response corrected image data, which accounts for the expected pixel response of the display pixels. To implement the mapping, in some embodiments, the pixel response correction block 44 may utilize one or more pixel response correction (PRC) look-up-tables (LUTs) 48.

In some embodiments, the pixel response correction block 44 may generate pixel response corrected image data by mapping the input image data using a corresponding pixel response correction look-up-table 48. Additionally or alternatively, the pixel response correction block 44 may generate the pixel response corrected image data by determining a pixel response correction offset using a corresponding pixel response correction look-up-table 48. Since pixel response may vary based on operational parameters associated with display of an image frame, in some embodiments, the pixel response correction block 44 may select from multiple pixel response correction look-up-tables 48 each corresponding with different sets of expected operational parameters.

For example, as described above, pixel response may vary based at least in part on refresh rate and, thus, display duration of image frames. Thus, in some embodiments, a different pixel response correction look-up-table 48 may be used for each possible refresh rate. For example, in some embodiments, the electronic display 12 may display image frames using a 60 Hz refresh rate, a 30 Hz refresh rate, a 15 Hz refresh rate, or a 10 Hz refresh rate. In such embodiments, the pixel response correction block 44 may include a 60 Hz look-up-table 48A used to determine pixel response corrected image data when an expected refresh rate is 60 Hz, a 30 Hz look-up-table 48B used to determine pixel response corrected image data when an expected refresh rate is 30 Hz, a 15 Hz look-up-table 48C used to determine pixel response corrected image data when an expected refresh rate is 15 Hz, and a 10 Hz look-up-table 48D used to determine pixel response corrected image data when an expected refresh rate is 10 Hz.

It should be noted that, in other embodiments, the electronic display 12 may be capable of displaying image frames using other refresh rates and, thus, the pixel response correction block 44 may include corresponding pixel response correction look-up-tables 48. To provide a few non-limiting examples, the electronic display 12 may be capable of displaying image frames at a 24 Hz refresh rate, a 26.67 Hz refresh rate, 30 Hz refresh rate, a 34.3 Hz refresh rate, a 40 Hz refresh rate, a 48 Hz refresh rate, a 60 Hz refresh rate, an 80 Hz refresh rate, a 120 Hz refresh rate, and/or a 240 Hz refresh rate. Thus, in such embodiments, the pixel response correction block 44 may include a 24 Hz look-up-table 48, a 26.67 Hz look-up-table 48, 30 Hz look-up-table 48, a 34.3 Hz look-up-table 48, a 40 Hz look-up-table 48, a 48 Hz look-up-table 48, the 60 Hz look-up-table 48A, an 80 Hz look-up-table 48, a 120 Hz look-up-table 48, and/or a 240 Hz look-up-table 48. Additionally or alternatively, the pixel response correction block 44 may calculate pixel response corrected image data as a function of at least the expected refresh rate.

In some embodiments, the expected operational parameters may be determined via the frame buffer 46, one or more sensors, and/or the controller 42. For example, a temperature sensor may determine sensor data indicative of temperature of the display panel. Additionally, the frame buffer 46 may store information indicative of expected luminance at the end of a directly previous image frame. For example, the frame buffer 46 may store information, such as actual refresh rate of the previous image frame, actual display duration of the previous image frame, expected refresh rate of the previous image frame, expected display duration of the previous image, image data used to display the previous image frame, and/or pixel response correction offset values applied to display the previous image frame. Additionally or alternatively, since used to control operation of the electronic display 12, the controller 42 may determine expected refresh rate and/or expected display duration, for example, based at least in part on refresh rate and/or display duration of previous image frames.

In this manner, the pixel response correction block 44 may determine pixel response corrected image data using one or more of the pixel response correction look-up-tables 48 selected based on expected operational parameters. Additionally, based at least in part on the pixel response corrected image data, the display driver 40 to write an image frame by applying analog electrical signals (e.g., voltage and/or current) to display pixels of the electronic display 12. Since expected to compensate for variations in pixel response, displaying an image frame based on pixel response corrected image data may reduce likelihood that variations in pixel response cause perceivable visual artifacts in the displayed image frame, thereby improving perceived image quality of the electronic display 12.

As described above, in some embodiments, the refresh rate with which each image frame is displayed may be adaptively (e.g., dynamically) adjusted, for example, based at least in part on when the display pipeline 36 receives image data corresponding to a subsequent image frame from the image data source 38. To help illustrate, one embodiment of a process 54 for displaying image frames using adaptive refresh rates is described in FIG. 6. Generally, the process 54 includes receiving image data corresponding to an image frame (process block 56), analyzing the image data (process block 58), processing the image data (process block 60), and displaying the image frame (process block 62). After displaying the image frame, the process 54 includes determining whether image data corresponding to a next image frame is received (decision block 64), continuing display of the image frame when not yet received (arrow 66), and analyzing the image data corresponding to the next image frame when received (arrow 68). In some embodiments, the process 54 may be implemented based on circuit connections (e.g., logic gates) formed in the display pipeline 36. Additionally or alternatively, the process 54 may be implemented by executing instructions stored in a tangible, non-transitory, computer-readable medium, such as the controller memory 52, using processing circuitry, such as the controller processor 50.

Accordingly, in some embodiments, the controller 42 may instruct the display pipeline 36 to receive image data corresponding to an image frame from the image data source 38. In some embodiments, the display pipeline 36 may receive the image data via a bus communicatively coupled between the image data source 38 and the display pipeline 36. In other embodiments, the display pipeline 36 may retrieve the image data from the local memory 20 and/or the main memory storage device 22. Additionally, in some embodiments, the display pipeline 36 may store the image data in the frame buffer 46.

After receiving the image data, the controller 42 may instruct the display pipeline 36 to analyze the image data (process block 58). In some embodiments, the display pipeline 36 may use the pixel response correction block 44 to analyze the image data by determining a grayscale value associated with each display pixel. Additionally, in some embodiments, a grayscale value may indicate target luminance of a display pixel in a linear domain.

Furthermore, the controller 42 may also instruct the display pipeline 36 to process the image data (process block 60). As described above, the display pipeline 36 may use the pixel response correction block 44 to process input image data to determine pixel response corrected image data. Additionally, as described above, the pixel response correction block 44 may determine pixel response corrected image data expected to account for variations in display pixel response (e.g., gradual decrease is stored voltage) based at least in part on expected operational parameters.

Figure 7:
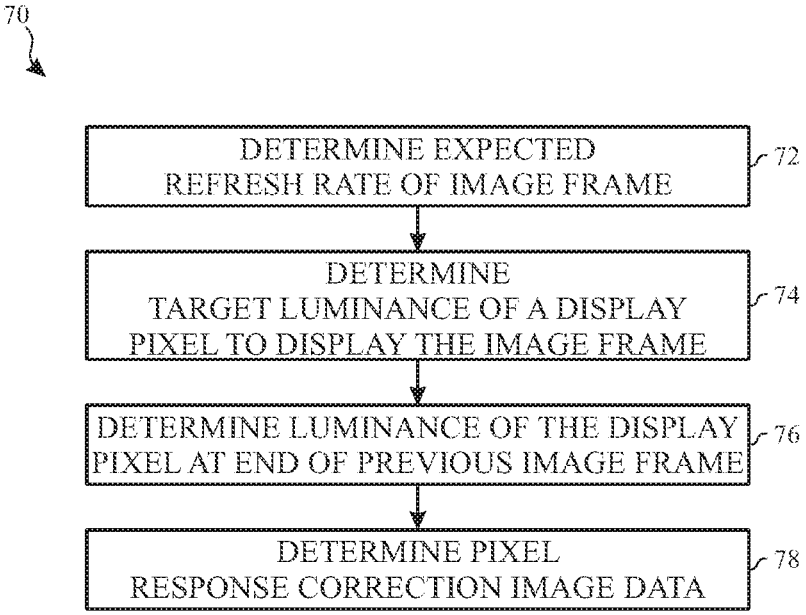
FIG. 7 is a flow diagram of a process for processing image data using pixel response correction offsets, in accordance with an embodiment.

To help illustrate, one embodiment of a process 70 for processing image data corresponding to an image frame is described in FIG. 7. Generally, the process 70 includes determining an expected refresh rate of the image frame (process block 72), determining target luminance of a display pixel to display the image frame (process block 74), determining luminance of the display pixel at the end of a previous image frame (process block 76), and determining pixel response corrected image data (process block 78). In some embodiments, the process 70 may be implemented based on circuit connections (e.g., logic gates) formed in the display pipeline 36. Additionally or alternatively, the process 70 may be implemented by executing instructions stored in a tangible, non-transitory, computer-readable medium, such as the controller memory 52, using processing circuitry, such as the controller processor 50.

Accordingly, in some embodiments, the controller 42 may instruct the pixel response correction block 44 to determine the expected refresh rate of a current image frame corresponding to the received image data (process block 72). In some embodiments, the pixel response correction block 44 may predict that the expected refresh rate based at least in part on actual refresh rate and/or actual display duration of one or more previous image frames. In fact, in some embodiments, the pixel response correction block 44 may vary how the expected refresh rate is determined to facilitate improving perceived image quality.

Figure 8:
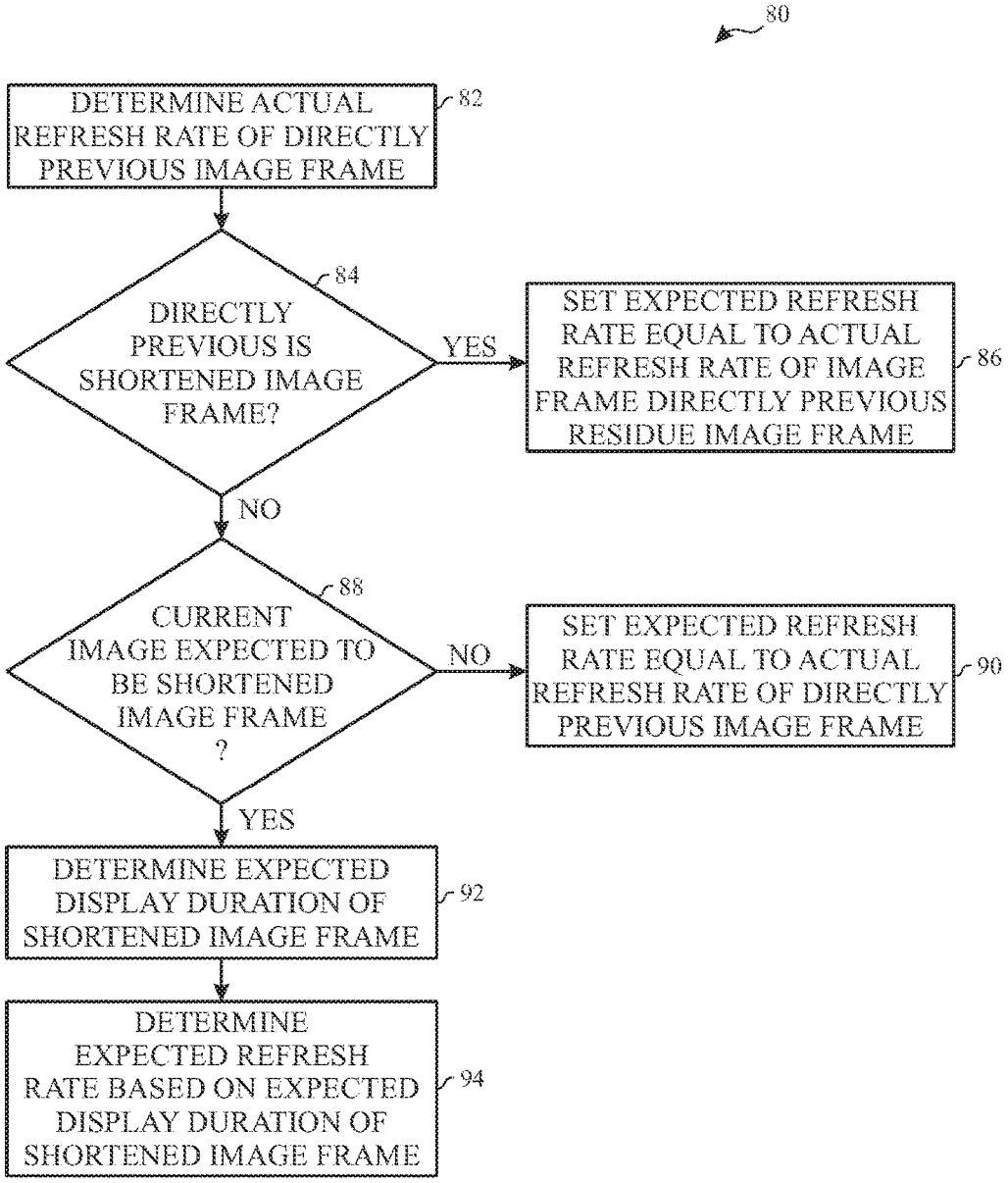
FIG. 8 is a flow diagram of a process for determining an expected refresh rate of an image frame, in accordance with an embodiment.

To help illustrate, one embodiment of a process 80 for determining expected refresh rate of a current image frame to be displayed is described in FIG. 8. Generally, the process 80 includes determining actual refresh rate of a directly previous image frame (process block 82), determining whether the directly previous image frame is a shortened image frame (decision block 84), setting expected refresh rate of a current image frame equal to actual refresh rate of an image frame directly previous the shortened image frame when the directly previous image frame is a shortened image frame (process block 86), determining whether the current image frame is expected to be a shortened image frame when the directly previous image frame is not a shortened image frame (decision block 88), and setting the expected refresh rate of the current image frame equal to the actual rate of the directly previous image frame when the current image frame is not expected to be a shortened image frame (process block 90).

When the current image frame is expected to be a shortened image frame, the process 80 includes determining expected display duration of the shortened image frame (process block 92) and determining the expected refresh rate of the current image frame based at least in part on the expected display duration of the shortened image frame (process block 94). In some embodiments, the process 80 may be implemented based on circuit connections (e.g., logic gates) formed in the display pipeline 36. Additionally or alternatively, the process 80 may be implemented by executing instructions stored in a tangible, non-transitory, computer-readable medium, such as the controller memory 52, using processing circuitry, such as the controller processor 50.

Accordingly, in some embodiments, the controller 42 may instruct the pixel response correction block 44 to determine actual refresh rate of an image frame directly previous a current image frame to be displayed (process block 82). In some embodiments, since generally controlling operation of an electronic display 12, the controller 42 may determine and communicate the actual refresh rate of the directly previous image frame to the pixel response correction block 44. Additionally or alternatively, the actual refresh rate of one or more previous may be in and, thus, retrieved from the frame buffer 46.

Based at least in part on the actual refresh rate, the controller 42 may instruct the pixel response correction block 44 to determine whether the directly previous image frame is a shortened image frame (decision block 84). In some embodiments, shortened image frames may include residue image frames and/or inverting image frames. In particular, a residue image frame may be a repeat image frame (e.g., after an artificial frame boundary) displayed with an actual refresh rate shorter than the actual refresh rate of its directly previous (e.g., initial or another repeat) image frame. In some embodiments, a residue image frame may result due to receipt of image data corresponding with a next subsequent image frame, for example, by the display pipeline 36 and/or the display driver 40.

Additionally, an inverting image frame may be an initial image frame displayed with a known shortened refresh rate (e.g., 120 Hz) followed by a repeat image frame displayed using opposite polarity analog electrical signals. In some embodiments, an inverting image frame may facilitate reducing magnitude of charge accumulation in the display pixels while alternating analog electrical signal polarities used to display successive image frames. In this manner, displaying an inverting image frame may facilitate improving perceived image quality, for example, by reducing likelihood of charge accumulation and/or non-alternating analog electrical signal polarities causing a perceivable visual artifact in a displayed image frame.

As such, the pixel response correction block 44 may determine that the directly previous image frame is an inverting image frame and, thus, a shortened image frame, for example, when the directly previous image frame is an initial image frame, the actual refresh rate of the directly previous image frame is the known shortened refresh rate, and the current frame is a repeat image frame. Additionally, the pixel response correction block 55 may determine that the directly previous image frame is a residue image frame and, thus, a shortened image frame, for example, when the directly previous image frame is a repeat image frame and the actual refresh rate of the directly previous image frame is less than the actual refresh rate of its directly previous image frame. Generally, when a shorted image frame, likelihood of actual refresh rate of the current image frame being equal to the actual refresh rate of the directly refresh rate may be lower.

Thus, when a shortened image frame, the controller 42 may instruct the pixel response correction block 44 to set the expected refresh rate of the current image frame equal to actual refresh rate of an image frame directly previous the shortened image frame (process block 86). For example, when the directly previous image frame is an inverting image frame or a residue image frame, the pixel response correction block 44 may set the expected refresh rate equal to actual refresh rate of an image frame two image frames prior the current image frame. It should be noted that, in some embodiments, when the directly previous image frame is an inverting image frame directly following a residue image frame, the pixel response correction block 44 may set the expected refresh rate equal to actual refresh rate of an image frame three image frames prior the current image frame. In this manner, the pixel response correction block 44 likelihood and/or magnitude of difference between the expected refresh rate and the actual refresh rate of the current image frame may be reduced, thereby improving perceived image quality.

On the other hand, when the directly previous image frame is not a shortened image frame, the controller 42 may instruct the pixel response correction block 44 to determine whether the current image frame is expected to be a shortened image frame (decision block 88). In other words, the pixel response correction block 44 may determine whether the current image frame is expected to be an inverting image frame and/or whether the current image frame is expected to be a residue image frame. In some embodiments, determination of whether expected to be an inverting image frame and determination of whether expected to be a residue image frame may vary.

Figure 9:
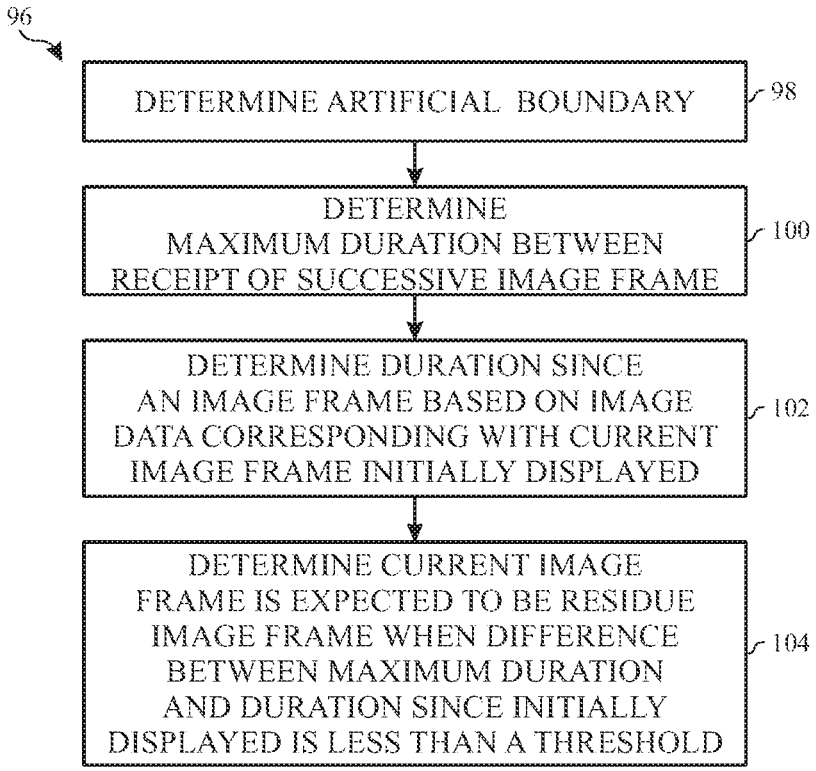
FIG. 9 is a flow diagram of a process for determining whether an image frame is expected to be a residue image frame, in accordance with an embodiment.

To help illustrate, one embodiment of a process 96 for determining whether a current image frame is expected to be a residue image frame is described in FIG. 9. Generally, the process 96 includes detecting an artificial frame boundary (process block 98), determining maximum duration between receipt of successive image frames (process block 100), determining duration since an image frame based on image data corresponding with current image frame was initially displayed (process block 102), and determining that the current image frame is expected to be a residue image frame when difference between the maximum duration and the duration since initial image frame displayed is less than a threshold (process block 104). In some embodiments, the process 96 may be implemented based on circuit connections (e.g., logic gates) formed in the display pipeline 36. Additionally or alternatively, the process 96 may be implemented by executing instructions stored in a tangible, non-transitory, computer-readable medium, such as the controller memory 52, using processing circuitry, such as the controller processor 50.

Accordingly, in some embodiments, the controller 42 may instruct the pixel response correction block 44 to detect whether an artificial frame boundary is present between the current image frame and the directly previous image frame (process block 98). In some embodiments, an artificial frame boundary may be inserted between successive image frames displayed based on the same image data. For example, a first artificial frame boundary may be present between an initial image frame and a first repeat image frame, a second artificial frame boundary may be present between the first repeat image frame and a second repeat image frame, and so on. Thus, by determining whether an artificial frame boundary is present, the pixel response correction block 44 may determine whether the current image frame is a repeat image frame.

Additionally, the controller 42 may instruct the pixel response correction block 44 to determine a maximum duration between receipt of image data corresponding with successive input image frames (process block 100). As described above, refresh rate may be dynamically adjusted based at least in part on when image data corresponding with a next image frame is received, for example, by the display pipeline 36 and/or the display driver 40. In other words, the maximum duration may indicate a maximum total display duration of an image frame and/or repeats of the image frame may be displayed before image data corresponding with the next image frame is received. For example, in some embodiments, the maximum total display duration may be approximately 41.67 ms or ten duration units each approximately 4.17 ms.

The controller 42 may also instruct the pixel response correction block 44 to determine duration since an initial image frame based on image data corresponding with the current image frame was displayed (process block 102). In other words, the pixel response correction block 44 may determine a previous total display duration of the initial image frame and/or any repeat image frames display directly before the current image frame (e.g., a repeat image frame). For example, when the directly previous image frame is an initial image frame displayed with an actual refresh rate of 34.3 Hz, the previous total display duration may be approximately 29.15 ms or seven duration units each approximately 4.17 ms.

Based at least in part on the maximum total display duration and the previous total display duration, the controller 42 may instruct the pixel response correction block 44 to determine whether the current image frame is expected to be a residue image frame. In particular, the pixel response correction block 44 may compare different between the maximum total display duration and the previous total display duration with a duration threshold. In some embodiments, the duration threshold may be set based at least in part on actual display duration of the directly previous image frame. For example, when the directly previous image frame is displayed with an actual refresh rate of 34.3 Hz, the duration threshold may be approximately 29.15 ms or seven duration units each approximately 4.17 ms. In other embodiments, the duration threshold may be fixed and/or adjusted in other suitable manners.

When the difference between the maximum total display duration and the previous total display duration is less than the duration threshold, the controller 42 may instruct the pixel response correction block 44 to determine that the current image frame is expected to be a residue image frame (process block 104). In particular, when the duration threshold is set based at least in part on the actual display duration of the directly previous image frame, a difference less than the duration threshold may indicate that refresh rate of the current image frame is expected to be greater than the actual refresh rate of the directly previous image frame. In such instances, the pixel response correction block 44 may determine that the current image frame is expected to be a residue image frame.

Figure 10:
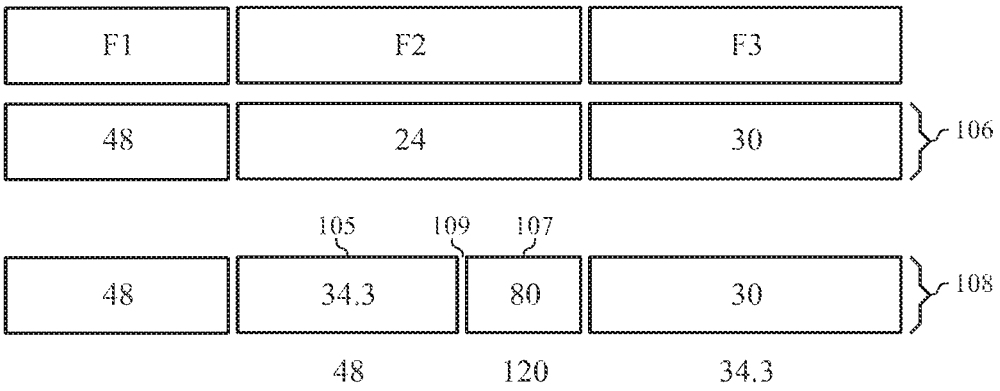
FIG. 10 illustrates example timing diagrams describing display of a residue image frame, in accordance with an embodiment.

To help illustrate, timing diagrams describing input image frames and displayed image frames are shown in FIG. 10. In particular, a first timing diagram 106 describes receipt of a first input image frame F1, a second input image frame F2, and a third input image frame F3, for example, by the display pipeline 36 and/or the display driver 40. Additionally, a second timing diagram 108 describes displayed image frames based on image data corresponding with the input image frames. It should be appreciated that the timing diagrams are merely intended to be illustrative of the techniques described herein and not limiting.

As indicated by the first timing diagram 106, first image data corresponding with the first input image frame F1 is received followed by second image data corresponding with the second input image frame F2 approximately 20.83 ms after the first image data. Subsequently, third image data corresponding with the third input image frame F3 is received approximately 41.67 ms after the second image data and image data corresponding with a next subsequent image data may be received approximately 33.33 ms after the third image data.

Additionally, as indicated by the second timing diagram 108, the first input image frame F1 is displayed as a single image frame and the third input image frame F3 is displayed as a single image frame. On the other hand, the second input image frame F2 is displayed as an initial image frame 105 and a repeat image frame 107 separated by an artificial frame boundary 109. It should be noted that the actual refresh rate of the repeat image frame 107 may be unknown when initially displayed since the third image data corresponding with the third input image frame F3 could be received at any suitable time after the second image data.

For the purpose of illustration, the maximum total display duration may be approximately 41.67 ms or ten duration units each approximately 4.17 ms. Additionally, since the initial image frame is displayed with an actual refresh rate of 34.3 Hz, the previous total display duration and, thus, duration threshold may be approximately 29.15 ms or seven duration units each approximately 4.17 ms. Accordingly, when the repeat image frame 107 is to be displayed, the pixel response correction block 44 may determine that the difference (e.g., 12.5 ms or three duration units) is less than the duration threshold and, thus, that the repeat image frame 107 is expected to be a residue image frame (e.g., a shortened image frame).

Figure 11:
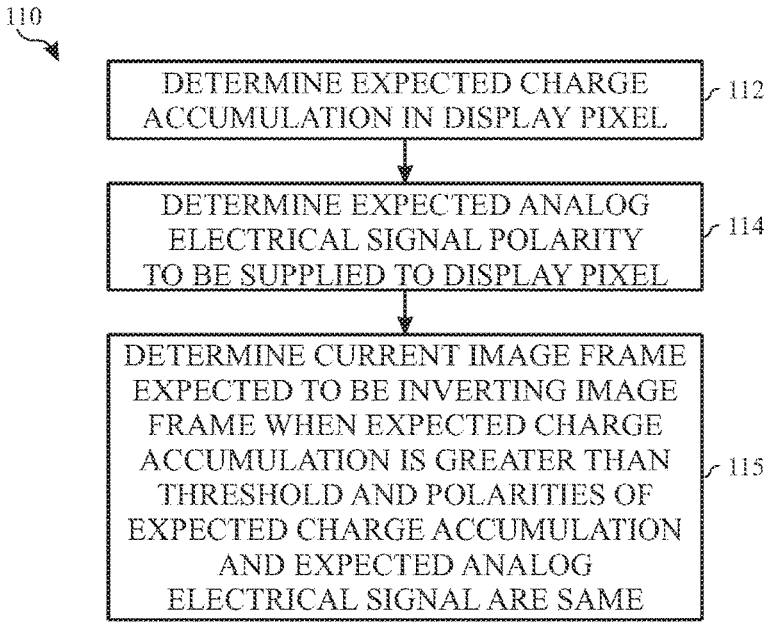
FIG. 11 is a flow diagram of a process for determining whether an image frame is expected to be an inverting image frame, in accordance with an embodiment.

Additionally, as described above, the pixel response correction block 44 may determine whether the current image frame is expected to be an inverting image frame, for example, after determining that the current image frame is not expected to be a residue image frame or vice versa. To help illustrate, one embodiment of a process 110 for determining whether a current image frame is expected to be an inverting image frame is described in FIG. 11. Generally, the process 110 includes determining expected charge accumulation in display pixels (process block 112), determining expected analog electrical signal polarity to be supplied to the display pixels (process block 114), and determining that a current image frame is expected to be an inverting image frame when the expected charge accumulation is greater than a threshold and polarity of the expected charge accumulation and the expected analog electrical signal polarity are the same (process block 116). In some embodiments, the process 110 may be implemented based on circuit connections (e.g., logic gates) formed in the display pipeline 36. Additionally or alternatively, the process 110 may be implemented by executing instructions stored in a tangible, non-transitory, computer-readable medium, such as the controller memory 52, using processing circuitry, such as the controller processor 50.

Accordingly, in some embodiments, the controller 42 may instruct the pixel response correction block 44 to determine expected charge accumulation in display pixels of the electronic display 12 before the current image frame is to be displayed (process block 112). In some embodiments, the expected charge accumulation may be determined based at least in part on operational parameters associated with display of one or more previous image frames. For example, the operational parameters associated with display of a previous image frame may include actual display duration of the previous image frame, actual refresh rate used to display the previous image frame, magnitude of analog electrical signals used to display the previous image frame, polarity of the analog electrical signal used to display the previous image frame and/or environmental conditions present when the previous image frame was displayed.

Additionally, in some embodiments, the controller 42 may instruct the pixel response correction block 44 to determine charge injection expected to result from display of the current image frame. In the embodiments, the expected charge injection may be determined based at least in expected operational parameters associated with display of the current image frame. For example, the expected operational parameters associated with display of the current image frame include expected display duration of the current image frame, refresh rate expected to be used to display the current image frame, magnitude of analog electrical signals expected to be used to display the current image frame, polarity of the analog electrical signal expected to be used to display the current image frame and/or environmental conditions expected to be present when the current image frame is to be displayed.

Thus, the controller 42 may instruct the pixel response correction block 44 to determine analog electrical signal polarity expected to be used to display the current image frame (process block 114). As described above, polarity of analog electrical signals supplied to display pixels to display an image frame may be controlled based at least in part on an inversion scheme implemented by the electronic display 12. In some embodiments, the inversion scheme may indicate that successive image frames are displayed using opposite analog electrical signal polarities. For example, one image frame may be displayed by supplying a positive analog electrical signal to a display pixel and a next subsequent image frame may be displayed by supplying a negative analog electrical signal to the display pixel. Thus, in some embodiments, the expected analog electrical signal polarity may be determined based at least in part on analog electrical signal polarity used to display a directly previous.

In some instances, charge accumulation in a display pixel may affect magnitude of a supplied analog electrical signal and, thus, perceived luminance of the display pixel. Additionally, in some embodiments, the effect on perceived luminance may increase as magnitude of the charge accumulation increases. In some embodiments, a charge accumulation threshold may be set at a point above which charge accumulation is likely to cause perceivable visual artifacts. Thus, to reduce likelihood of charge accumulation resulting in perceivable visual artifact, the pixel response correction block 44 may compare the expected charge accumulation with the charge accumulation threshold.

Additionally, in some instances, charge injection caused by displaying an image frame may result in increasing or decreasing magnitude of the charge accumulation in the display pixels. For example, positive charge injection may increase magnitude of positive charge injection in a display pixel. On the other hand, positive charge injection may reduce magnitude of negative charge injection in the display pixel. As such, to reduce likelihood of charge accumulation resulting in perceivable visual artifact, pixel response correction block 44 may compare the polarity of the expected charge accumulation and expected polarity of analog electrical signals to be used to display the current image frame.

When the polarities are the same and the expected charge accumulation exceeds the charge accumulation threshold, the controller 42 may instruct the pixel response correction block 44 to determine that the current image frame is expected to be an inverting image frame (process block 116). In some embodiments, perceived image quality may be improved by alternating analog electrical signal polarities used to display successive image frames, for example, by reducing likelihood of luminance spikes caused by using non-alternating analog electrical signal polarities. Thus, in some embodiments, an electronic display 12 may display an initial image frame as an inverting image frame with a known shortened refresh rate followed by a repeat image frame displayed using analog electrical signal polarities opposite the polarity of the expected charge accumulation.

Figure 12:
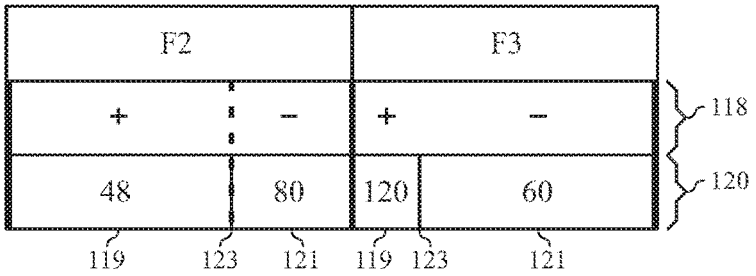
FIG. 12 illustrates example timing diagrams describing display of an inverting image frame, in accordance with an embodiment.

To help illustrate, timing diagrams describing input image frames and displayed image frames are shown in FIG. 12. In particular, a first timing diagram 118 describes receipt of a first input image frame F1 and a second input image frame F2, for example, by the display pipeline 36 and/or the display driver 40. Additionally, a second timing diagram 120 describes displayed image frames based on image data corresponding with the input image frames. It should be appreciated that the timing diagrams are merely intended to be illustrative of the techniques described herein and not limiting.

As indicated by the first timing diagram 118, first image data corresponding with the first input image frame F1 is received followed by second image data corresponding with the second input image frame F2 approximately 33.33 ms after the first image data. Subsequently, image data corresponding with a next subsequent image data may be received approximately 25 ms after the second image data.

Additionally, as indicated by the second timing diagram 120, the first input image frame F1 is displayed as a first initial image frame 119 and a first repeat image frame 121 separated by a first artificial frame boundary 123. For the purpose of illustration, displaying the first initial image frame 119 using a positive analog electrical signal may result in positive charge accumulation expected to exceed the charge accumulation threshold at the first artificial frame boundary 123. As such, the first repeat image frame 121 is subsequently displayed using a negative analog electrical signal to facilitate reducing magnitude of the expected charge accumulation.

However, for the purpose of illustration, the positive charge accumulation may still be expected to be greater than the charge accumulation threshold after display of the first repeat image frame 121. Thus, as indicated by the second timing diagram 120, the second input image frame F2 is displayed as a second initial image frame 125 and a first repeat image frame 127 separated by a first artificial frame boundary 129. Since the first repeat image frame 121 is displayed using a negative analog electrical signal, the second initial image frame 119 is displayed using a positive analog electrical signal. However, since polarity is the same as the expected charge accumulation, the second initial image frame 119 is displayed as an inverting image frame with a shortened refresh rate followed by the second repeat image frame 127 displayed using a negative analog electrical signal to facilitate reducing magnitude of the expected charge accumulation. Accordingly, since polarities are the same and expected charge accumulation exceeds the threshold when the second initial image frame 125 is to be displayed, the pixel response correction block 44 may determine that the second initial image frame 125 is expected to be an inverting image frame (e.g., a shortened image frame).

In this manner, the pixel response correction block 44 may determine whether the current image frame is expected to be a shorted image frame. For example, the pixel response correction block 44 may determine that the current image frame is expected to be a shortened image frame when the current image frame is expected to be a residue image frame or an inverting image frame. On the other hand, the pixel response correction block 44 may determine current frame is not expected to be a shortened refresh rate when the current image frame is not expected to be a residue image frame and not expected to be an inverting image frame.

Returning to the process 80 of FIG. 8, the controller 42 may instruct the pixel response correction block 44 to set the expected refresh rate of the current image frame equal to the actual fresh rate of the directly previous image frame when the current image frame is not expected to be a shortened image frame (process block 90). On the other hand, when the current image frame is expected to be a shortened image frame, the controller 42 may instruct the pixel response correction block 44 to determine an expected display duration of the shortened image frame (process block 92). For example, when the current image frame is expected to be an inverting image frame, the pixel response correction block 44 may determine that the expected display duration is the known shortened display duration. However, as described above, the display duration and/or refresh rate of a residue image frame may be unknown and, thus, predicted.

Figure 13:
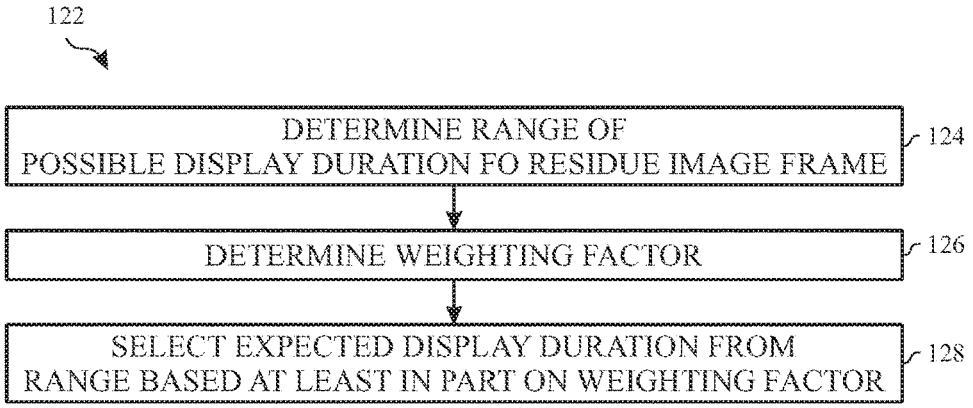
FIG. 13 is a flow diagram of a process for determining expected refresh rate of a residue image frame, in accordance with an embodiment.

To help illustrate, one embodiment of a process 122 for determining expected refresh rate of a residue image frame is described in FIG. 13. Generally, the process 122 includes determining a range of possible display durations of a residue image frame (process block 124), determining a weighting factor (process block 126), and selecting an expected display duration from the range based at least in part on the weighting factor (process block 128). In some embodiments, the process 122 may be implemented based on circuit connections (e.g., logic gates) formed in the display pipeline 36. Additionally or alternatively, the process 122 may be implemented by executing instructions stored in a tangible, non-transitory, computer-readable medium, such as the controller memory 52, using processing circuitry, such as the controller processor 50.

Accordingly, in some embodiments, the controller 42 may instruct the pixel response correction block 44 to determine a range of possible display durations of the residue image frame (process block 124). In some embodiments, the range of possible display durations may be determined based at least in part on the maximum total display duration and the previous total display duration. For example, when the maximum total display duration is 41.67 ms and the previous total display duration is 29.15 ms, the residue image frame could potentially be displayed anywhere from 0 ms to 12.5 ms. In some embodiments, display duration of an image frame may be adjusted using fixed increments, for example, 4.17 ms duration units. Thus, continuing with the above example, the range of possible display durations for the residue image frame may include one duration unit (e.g., 4.17 ms), two duration units (e.g., 8.33 ms), and three duration units (e.g., 12.5 ms).

Additionally, the controller 42 may instruct the pixel response correction block 44 to determine a weighting factor (process block 126) and to determine the expected refresh rate of the residue image frame based at least in part on the weighting factor (process block 128). In some embodiments, the pixel response correction block 44 may determining the expected display duration by selecting a display duration from the range of possible display durations based at least in part on a search criteria. For example, in some embodiments, the search criteria may indicate that the median of the range should be selected as the expected display duration. In other embodiments, the search criteria may indicate that a maximum or a minimum of the range should be selected as the expected display duration.

Additionally, in some embodiments, the weighting factor may be used to adjust the search criteria. For example, the weighting factor may be used to skew the search criteria. In some embodiments, the weighting factor may be expressed in terms of one or more duration units. For example, a weighting factor of minus one duration units may skew selection toward shorter display durations in the range. Furthermore, in some embodiments, the weighting factor may be determined (e.g., empirically) to facilitate reducing perceivability of any luminance variation resulting from mismatch between the expected refresh rate and the actual refresh rate of the residue image frame. In this manner, the pixel response correction block 44 may determine the expected display duration of the current image frame when expected to be a residue image frame.

Returning to the process 80 of FIG. 8, the controller 42 may instruct the pixel response correction block 44 to determine the expected refresh rate of the current image frame based at least in part on the expected display duration of the shortened image frame (process block 94). In particular, the pixel response correction block 44 may determine that the expected refresh rate is the inverse of the expected display duration. For example, when expected to be an inverting image frame or the expected display duration is two duration units, the pixel response correction block 44 may determine that the expected refresh rate of the current image frame is 120 Hz. Additionally, the pixel response correction block 44 may determine that the expected refresh rate is 80 Hz when the expected display duration is three duration units, 60 Hz when the expected display duration is four duration units, and so on.

Returning to the process 70 of FIG. 7, the controller 42 may instruct the pixel response correction block 44 to determine target luminance of a display pixel to display the current image frame (process block 74). As described above, in some embodiments, the display pipeline 36 may determine the target luminance based at least in part on the grayscale value indicated in the portion of the image data associated with the display pixel. Additionally, in some embodiments, the grayscale values may be stored in the frame buffer 46. Accordingly, in such embodiments, the pixel response correction block 44 may retrieve the target luminance of the display pixel from the frame buffer 46.

Furthermore, the controller 42 may instruct the pixel response correction block 44 to determine luminance of the display pixel when the current image frame is to be displayed (process block 76). In other words, since the current image frame is displayed after a directly previous image frame, the luminance of the display pixel when the current image frame is to be displayed may be the luminance of the display pixel at the end of the directly previous image frame. In some instances, the luminance of a display pixel may be dynamic while displaying an image frame. For example, the luminance may spike, increasing rapidly when the image frame is initially displayed and gradually decreasing the longer the image frame is displayed.

In some embodiments, the pixel response correction block 44 may determine the luminance of the display pixel at the end of the directly previous image frame based at least in part on expected refresh rate/display duration of the directly previous image frame, the actual refresh rate/display duration of the directly previous image frame, and/or the pixel response correction offset value applied to display the directly previous image frame. As described above, in some embodiments, such information may be stored in the frame buffer 46. Accordingly, in such embodiments, the pixel response correction block 44 may retrieve the information indicative of the luminance of the display pixel when the current image frame is to be displayed from the frame buffer 46.

The controller 42 may then instruct the pixel response correction block 44 to determine pixel response corrected image data (process block 78). In some embodiments, the pixel response correction block 44 may determine the pixel response corrected image data based at least in part on the expected refresh rate of the image frame to be displayed, the target luminance of the display pixel to display the current image frame, and/or the luminance of the display pixel at the end of the directly previous image frame. Additionally, in some embodiments, the pixel response correction block 44 may store the pixel response corrected (e.g., processed) image data in the frame buffer 46.

As described above, in some embodiments, the pixel response correction block 44 may determine the pixel response corrected image data by mapping input image data using a pixel response correction look-up-table 48. Additionally or alternatively, in some embodiments, the pixel response correction block 44 may determine the pixel response corrected image data by determining a pixel response correction offset based at least in part on a pixel response correction look-up-table 48 and applying the pixel response correction offset to the input image data. In some embodiments, the pixel response correction block 44 may apply the pixel response correction offset by adding the pixel response correction offset to a grayscale value in the image data received from the image data source 38. As described above, in some embodiments, the pixel response correction look-up-tables 48 may be organized based on expected refresh rate.

Figures 14, 15:
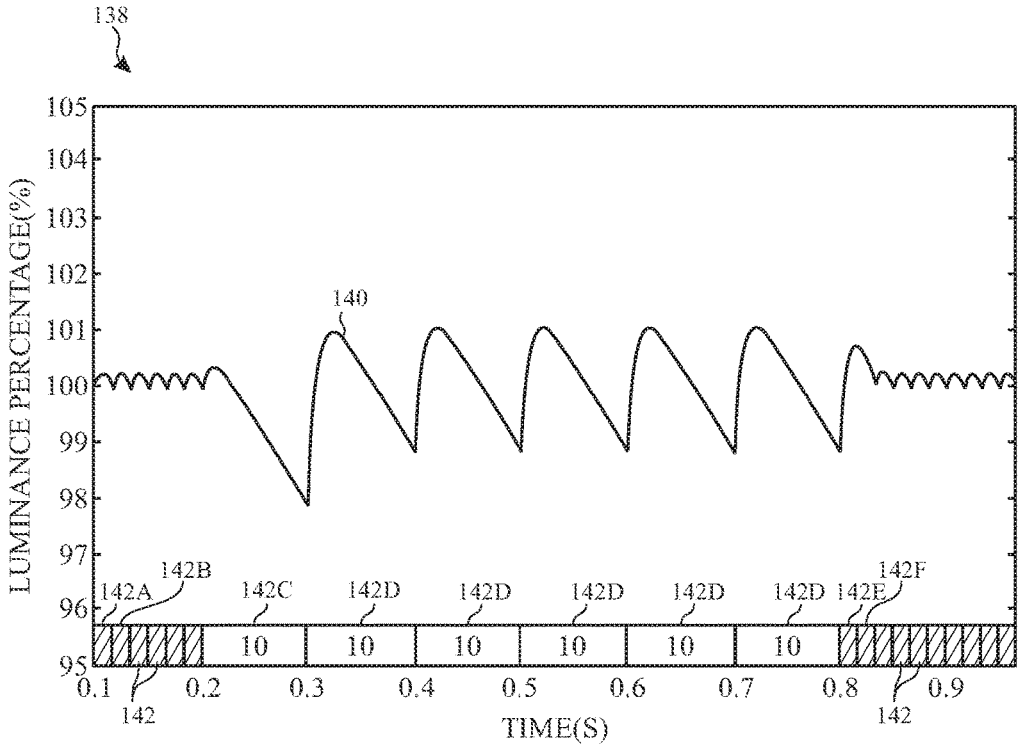
FIG. 14 is an example of a pixel response correction look-up-table used to determine pixel response correction offset, in accordance with an embodiment.
FIG. 15 is a plot of luminance of a display pixel when using a direct transition technique, in accordance with an embodiment.

To help illustrate, FIG. 14 illustrates a graphical representation of an example of the 30 Hz look-up-table 48B, which may be used to determine pixel response correction offsets when expected refresh rate of an image frame is 30 Hz. In the depicted embodiment, each row of the 30 Hz look-up-table 48B associates various sets of operational parameters to a corresponding pixel response correction offset value. For example, a first row 130 indicates that the pixel response correction offset value is 4 when the expected refresh rate of the current image frame is 30 Hz, the target luminance is 10, the expected refresh rate of the directly previous image frame is 30 Hz, and the pixel response correction offset value applied to display the directly previous image frame is 4.

As described above, in some embodiments, the expected refresh rate of the current image frame may be determined based on the actual refresh rate of a previous image frame. Thus, in such embodiments, the actual refresh rate of the previous image frame may be 30 Hz. As such, the expected refresh rate of the previous image frame matches the actual refresh rate and, thus, the pixel response correction offset applied to display the previous image frame may enable the perceived luminance of the display pixel to substantially match the target luminance of the display pixel.

However, as described above, the actual refresh rate of an image frame may not be known when an image frame is initially displayed. Thus, in other instances, the expected refresh rate of the previous image frame may not match the actual refresh rate. In such instances, even when the actual refresh rate is the same, the luminance of the display pixel may vary at the end of the previous image frame based at least in part on the expected refresh rate of the previous image frame and/or the pixel response correction offset value applied to display the previous image frame. Thus, to facilitate reducing difference between perceived luminance and target luminance of the display pixel in the current image frame, the electronic display 12 may adjust the pixel response correction offset value applied to compensate.

For example, when the previous pixel response correction offset is determined based on an expected refresh rate greater than the actual refresh rate, the luminance of the display pixel at the end of the previous image frame may be lower. As such, the pixel response correction block 44 may increase the pixel response correction offset applied to display the current image frame. For example, in the depicted embodiment, a second row 132 indicates that the pixel response correction offset value is 6 when the expected refresh rate of the current image frame is 30 Hz, the target luminance is 10, the expected refresh rate of the previous image frame is 60 Hz, and the pixel response correction offset value applied to display the previous image frame is 2. As such, the actual refresh rate of the previous image frame may be 30 Hz. Since the expected refresh rate is greater than the actual refresh rate of the previous image frame, the pixel response correction block 44 may compensate by increasing the pixel response correction offset value applied to display the current image frame.

On the other hand, when the previous pixel response correction offset is determined based on an expected refresh rate less than the actual refresh rate, the luminance of the display pixel at the end of the previous image frame may be higher. As such, the pixel response correction block 44 may decrease the pixel response correction offset applied to display the current image frame. For example, in the depicted embodiment, a third row 134 indicates that the pixel response correction offset value is 2 when the expected refresh rate of the current image frame is 30 Hz, the target luminance is 10, the expected refresh rate of the previous image frame is 15 Hz, and the pixel response correction offset value applied to display the previous image frame is 8. As such, the actual refresh rate of the previous image frame may be 30 Hz. Since the expected refresh rate is less than the actual refresh rate of the previous image frame, the pixel response correction block 44 may compensate by decreasing the pixel response correction offset value applied to display the current image frame.

Additionally, in some embodiments, a pixel response correction offset may be applied to gamma correct the image data. For example, to gamma correct, the pixel response correction block 44 may increase the pixel response correction offset applied as the target luminance increases. In other words, the pixel response correction block 44 may adjust the pixel response correction offset based at least in part on the target luminance of the display pixel. For example, in the depicted embodiment, a fourth row 136 indicates that the pixel response correction offset value is 5 when the expected refresh rate of the current image frame is 30 Hz, the target luminance is 20, the expected refresh rate of the previous image frame is 30 Hz, and the pixel response correction offset value applied to display the previous image frame is 4.

Thus, using the 30 Hz pixel response correction look-up-table 48B, the pixel response correction block 44 may determine pixel response corrected image data for various sets of operational parameters when the expected refresh rate of the current image frame is 30 Hz. Although only four rows are depicted, in should be appreciated that the 30 Hz pixel response correction look-up-table 48B may include additional rows that associate other sets of operational parameters to corresponding pixel response offset values. Additionally, in a similar manner, the pixel response correction block 44 may use other pixel response correction look-up-tables 48 to determine pixel response corrected image data when the current image frame has other expected refresh rates.

Figure 6:
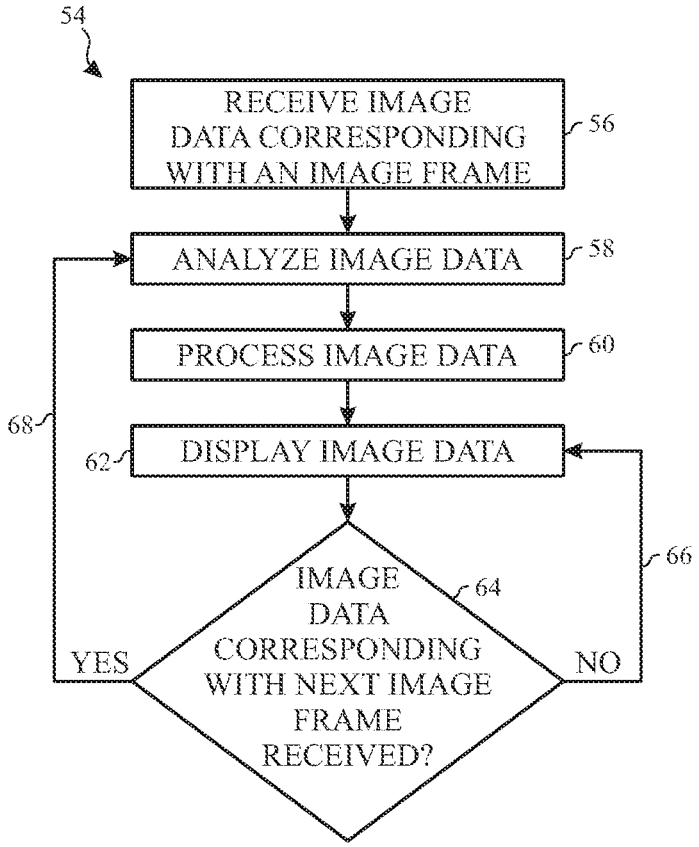
FIG. 6 is a flow diagram of a process for displaying image frames using adaptive refresh rates, in accordance with an embodiment.

Returning to the process 54 described in FIG. 6, the controller 42 may instruct the display pipeline 36 to output the processed (e.g., pixel response corrected) image data to the display driver 40 and the display driver 40 to overwrite the directly previous image frame with the current image frame (process block 62). As described above, the display driver 40 may apply an analog electrical signal (e.g., voltage and/or current) to a display pixel of the electronic display 12 to control light emission from the display pixel and, thus, luminance of the display pixel. Accordingly, the display driver 40 may display the current image frame by applying analog electrical signals to display pixels based on the processed image data. In other words, the display driver 40 may convert the digital representation of luminance in the processed image data into an analog representation (e.g., voltage signal applied to the display pixels).

Additionally, the controller 42 may instruct the display pipeline 36 to determine whether image data corresponding to a next subsequent image frame to be displayed is received (decision block 64). As described above, the electronic display 12 may display an image frame based at least in part on when corresponding image data is received. Thus, when image data corresponding to the next subsequent image frame is received, the controller 42 may instruct the display pipeline 36 to analyze the image data (process block 58) and process the image data (process block 60). Additionally, the controller 42 may instruct the display driver 40 to overwrite the current image frame with the next subsequent image frame. As such, the display duration and, thus, the refresh rate of the current image frame may be adaptively (e.g., dynamically) adjusted based at least in part on when the image data correction with the next subsequent image frame is received.

On the other hand, when the image data corresponding to next subsequent image frame is not yet received, the controller 42 may instruct the electronic display 12 to continue presenting the visual representation of the current image frame (process block 62). In some embodiments, the visual representation of the current image frame may be presented by continuing display of the current image frame and/or displaying a repeat of the current image frame (e.g., rewriting the current image frame to the display pixels). However, the electronic display 12 may determine how to continue presentation of the visual representation based on various factors, such as capabilities (e.g., pixel response characteristics) of the electronic display 12, target (e.g., desired) image quality (e.g., perceptibility of visual artifacts), and/or target (e.g., desired) power consumption of the electronic display 12.

For example, as described above, an electronic display 12 may be capable of displaying image frames at multiple refresh rates from a lower threshold refresh rate (e.g., 10 Hz) and a higher threshold refresh rate (e.g., 120 Hz). However, different electronic displays 12 may be capable of using different refresh rates. Additionally, as described above, power consumption of the electronic display 12 may be reduced by reducing the refresh rate with which image frames are displayed. As such, power consumption of the electronic display 12 may be most reduced when image frames are displayed at the lower threshold refresh rate. However, technique used to transition from a higher refresh rate to the lower threshold refresh rate may affect perceptibility of visual artifacts in displayed image frames.

To help illustrate, FIG. 15 depicts a plot 138 describing operation of an electronic display 12 using a direct transition technique (e.g., directly transitioning from a higher refresh rate to a lower threshold refresh rate) when a display pipeline 36 receives a hypothetical image data stream. Specifically, the plot 138 includes a first luminance curve 140 that indicates luminance of a display pixel used to display image frames 142 based on the hypothetical image data stream relative to target luminance (e.g., 100% luminance). Based on the hypothetical image data stream, the display pipeline 36 may receive image data corresponding to a different image frame 142 approximately every 16.67 ms seconds between 0.1 to 0.2 seconds. Additionally, the display pipeline 36 may temporarily cease receiving image data for approximately 0.6 seconds between 0.2 to 0.8 seconds. Furthermore, the display pipeline 36 may resume receiving image data corresponding to a different image frame 142 approximately every 16.67 ms after 0.8 seconds.

As described above, in the hypothetical image data steam, the display pipeline 36 receives image data corresponding to a different image frame 142 approximately every 16.67 ms between 0.1 to 0.2 seconds. Thus, the display pipeline 36 may determine that the actual refresh rate of the directly previous image frame 142 of each image frame 142 is 60 Hz. For example, approximately 16.67 ms after first image data corresponding to a first image frame 142A is received, the display pipeline 36 may receive second image data corresponding to a second image frame 142B. As such, the display pipeline 36 may determine that the actual refresh rate of the first image frame 142A is 60 Hz.

Before displaying each image frame 142 between 0.1 to 0.2 seconds, the display pipeline 36 may process corresponding image data. For example, the display pipeline 36 may process the second image data by applying a pixel response correction offset to a grayscale value of the second image data based at least in part on expected refresh rate of the second image frame 142B. Since the directly previous image frame (e.g., first image frame 142A) is displayed with a 60 Hz refresh rate, the display pipeline 36 may determine that the expected refresh rate of the second image frame 142B is 60 Hz and, thus, apply a 60 Hz pixel response correction offset to the second image data.

Based at least in part on the processed (e.g., pixel response corrected) second image data, the electronic display 12 may display the seconds image frame 142B by applying an analog electrical signal to the display pixel. Accordingly, as described by the first luminance curve 140, luminance of display pixel spikes (e.g., increases rapidly) to approximately 0.2% above the target luminance (e.g., 100% luminance) when each image frame 142 between 0.1 to 0.2 seconds is initially displayed and gradually decreases to approximately 0.2% below the target luminance by the end of the image frame 142. In this manner, as depicted, area above and below the target luminance is approximately equal, thereby resulting in average (e.g., perceived) luminance of the display pixel being approximately equal to the target luminance when displaying the image frame 142 between 0.1 to 0.2 seconds.

As described above, in the hypothetical image data steam, the display pipeline 36 temporarily ceases receiving image data for approximately 0.6 seconds. Thus, the electronic display 12 may continue presentation of the visual representation of an image frame 142 (e.g., a third image frame 142C) corresponding to most recently received image data (e.g., third image data). For example, the electronic display 12 may display the third image frame 142C and/or one or more repeat image frame 142D (e.g., repeats of the third image frame 142C).

Using the direct transition technique, the electronic display 12 may attempt to directly reduce refresh rate to the lower threshold refresh rate. For example, using a 10 Hz lower threshold refresh rate, the electronic display 12 may display each image frame 142 up to 10 ms (e.g., a display duration threshold). Since the display pipeline 36 ceases receiving image data for approximately 0.6 seconds, the electronic display 12 may display the third image frame 142C and/or the one or more repeat image frames 142D using the 10 Hz lower threshold refresh rate.

Before displaying the third image frame 142C, the display pipeline 36 may process the third image data, for example, by applying a pixel response correction offset to a grayscale value of the third image data based at least in part on expected refresh rate of the third image frame 142C. Since the directly previous image frame is displayed with a 60 Hz refresh rate, the display pipeline 36 may determine that the expected refresh rate of the third image frame 142C is 60 Hz and, thus, apply a 60 Hz pixel response correction offset to the third image data.

Based at least in part on the processed (e.g., pixel response corrected) third image data, the electronic display 12 may display the third image frame 142C by applying an analog electrical signal to the display pixel. As described by the first luminance curve 140, luminance of the display pixel spikes (e.g., increases rapidly) to approximately 0.2% above the target luminance (e.g., 100% luminance) when the third image frame 142C is initially displayed at 0.2 seconds and gradually decreases to approximately 2.5% below the target luminance by the end of the third image frame 142C at 0.3 seconds. However, since a 60 Hz pixel response correction offset is applied to the third image data, the pixel response correction offset is insufficient to compensate for the decrease in the stored analog electrical signal across the third image frame 142C. Thus, as depicted, area above the desire luminance is less than area below the target luminance, thereby resulting in average (e.g., perceived) luminance of the display pixel being lower than the target luminance when the third image frame 142C is displayed.

Before displaying each repeat image frame 142D, the display pipeline 36 may reprocess the third image data, for example, by applying a pixel response correction offset to grayscale values of the third image data based at least in part on an expected refresh rate of the repeat image frame 142D. Since the directly previous image frame (e.g., third image frame 142C or another repeat image frame 142D) is displayed with a 10 Hz refresh rate, the display pipeline 36 may determine that the expected refresh rate of the repeat image frame 142D is 10 Hz and, thus, apply a 10 Hz pixel response correction offset to the third image data.

Based at least in part on the reprocessed (e.g., pixel response corrected) third image data, the electronic display 12 may display each repeat image frame 142D between 0.3 to 0.8 seconds by applying an analog electrical signal to the display pixel. Accordingly, as described by the first luminance curve 140, luminance of the display pixel spikes (e.g., increases rapidly) to approximately 1% above the target luminance (e.g., 100% luminance) when each repeat image frame 142D is initially displayed and gradually decreases to approximately 1% below the target luminance by the end of the repeat image frame 142D. In this manner, as depicted, area above and below the target luminance is approximately equal, thereby resulting in average (e.g., perceived) luminance of the display pixel being approximately equal to the target luminance when displaying the repeat image frames 142D.

As described above, in the hypothetical image data steam, the display pipeline 36 resumes receiving image data after approximately 0.6 seconds. For example, the display pipeline 36 may receive fourth image data corresponding to a fourth image frame 142E approximately 0.6 seconds after the third image data. As such, the display pipeline 36 may determine that the actual refresh rate of the directly previous image frame 142 (e.g., a repeat image frame 142D displayed between 0.7 to 0.8 seconds) is 10 Hz.

Before displaying the fourth image frame 142E, the display pipeline 36 may process the fourth image data, for example, by applying a pixel response correction offset to a grayscale value of the fourth image data based at least in part on expected refresh rate of the fourth image frame 142E. Since the directly previous image frame is displayed with a 10 Hz refresh rate, the display pipeline 36 may determine that the expected refresh rate of the fourth image frame 142E is 10 Hz and, thus, apply a 10 Hz pixel response correction offset to the fourth image data.

Based at least in part on the processed (e.g., pixel response corrected) fourth image data, the electronic display 12 may display the fourth image frame 142E by applying an analog electrical signal to the display pixel. Accordingly, as described by the first luminance curve 140, luminance of display pixel spikes (e.g., increases rapidly) approximately 0.8% above the target luminance (e.g., 100% luminance) when the fourth image frame 142E is initially displayed at 0.8 s and gradually decreases to approximately the target luminance by the end of the fourth image frame 142E. However, since a 10 Hz pixel response correction offset is applied to the fourth image data, the pixel response correction offset may overcompensate for the decrease in the stored analog electrical signal across the fourth image frame 142E. Thus, as depicted, area above the target luminance is greater than area below the target luminance, thereby resulting in average (e.g., perceived) luminance of the display pixel being higher than the target luminance when the fourth image frame 142E is displayed.

As described above, in the hypothetical image data steam, the display pipeline 36 receives image data corresponding to a different image frame 142 approximately every 16.67 ms after 0.8 s. For example, the display pipeline 36 may receive fifth image data corresponding to a fifth image frame 142F approximately 16.67 ms after the fourth image data. Thus, the display pipeline 36 may determine that the actual refresh rate of the directly previous image frame 142 of each image frame 142 is 60 Hz. For example, approximately 16.67 ms after fourth image, the display pipeline 36 may receive fifth image data corresponding to a fifth image frame 142F. As such, the display pipeline 36 may determine that the actual refresh rate of the fourth image frame 142E is 60 Hz.

Before displaying each image frame 142 after 0.8 s, the display pipeline 36 may process corresponding image data. For example, the display pipeline 36 may process the fifth image data by applying a pixel response correction offset to a grayscale value of the fifth image data based at least in part on expected refresh rate of the fifth image frame 142F. Since the directly previous image frame (e.g., fourth image frame 142E) is displayed with a 60 Hz refresh rate, the display pipeline 36 may determine that the expected refresh rate of the fifth image frame 142F is 60 Hz and, thus, apply a 60 Hz pixel response correction offset to the fifth image data.

Based at least in part on the processed (e.g., pixel response corrected) fifth image data, the electronic display 12 may display the fifth image frame 142F by applying an analog electrical signal to the display pixel. Accordingly, as described by the first luminance curve 140, luminance of display pixel spikes (e.g., increases rapidly) to approximately 0.2% above the target luminance (e.g., 100% luminance) when each image frame 142 after 0.8 s is initially displayed and gradually decreases to approximately 0.2% below the target luminance by the end of the image frame 142. In this manner, as depicted, area above and below the target luminance is approximately equal, thereby resulting in average (e.g., perceived) luminance of the display pixel being approximately equal to the target luminance when displaying the image frames 142 after 0.8 s.

Accordingly, using the direct transition technique, average (e.g., perceived) luminance of the display pixel may vary from target luminance when the third image frame 142C and the fourth image frame 142E are displayed due to pixel response correction offsets being applied based on expected refresh rates different from the actual refresh rates. However, perceptibility of the variations may be different. For example, due to longer duration, perceptibility of variations in the third image frame 142C may be greater than perceptibility of variations in the fourth image frame 142E.

Figure 16:
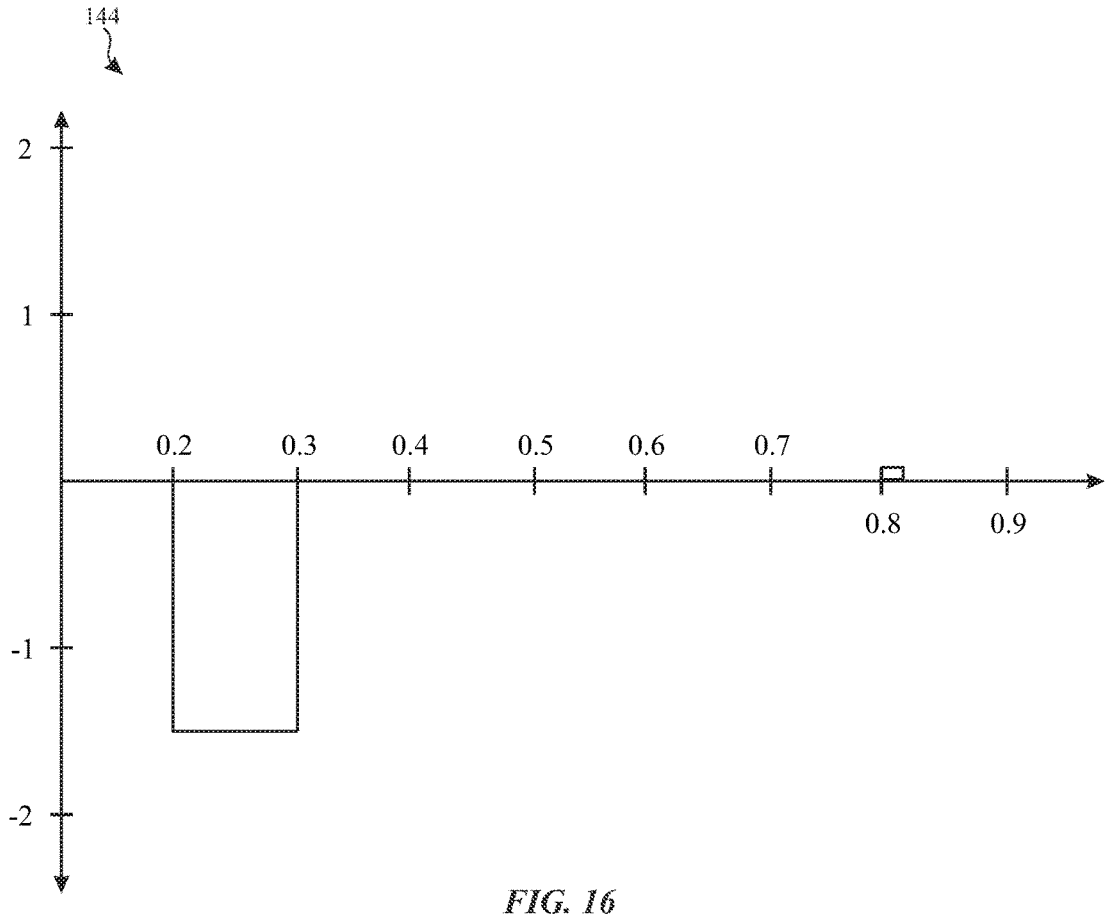
FIG. 16 is a plot of difference between average luminance and target luminance of the display pixel from FIG. 15, in accordance with an embodiment.

To help illustrate, FIG. 16 depicts a plot 144 that presents a graphical representation of difference (e.g., integral of first luminance curve 140 relative to 100% luminance) between target luminance (e.g., 100% luminance) and average luminance of the display pixel when displaying the image frames 142 using the direct transition technique. As depicted, the difference is approximately zero between 0.1 to 0.2 seconds, between 0.3 to 0.8 seconds, and between approximately 0.817 seconds to 0.9 seconds. As described above, the image frames 142 displayed during those durations had expected refresh rates equal to their actual refresh rates. Thus, pixel response correction offsets applied to the corresponding image data was able to facilitate the average luminance being approximately equal to the target luminance.

Additionally, as depicted, a positive difference is present between approximately 0.8 to 0.817 seconds. As described above, the fourth image frame 142E is displayed during that duration with a 10 Hz expected refresh rate, but a 60 Hz actual refresh rate. Thus, the pixel response correction offset applied to the fourth image data overcompensated, thereby resulting in the average luminance of the display pixel during the fourth image frame 142E being greater than the target luminance. However, due to the short duration (e.g., 16.67 ms), the difference resulting in the fourth image frame 142E may be relatively small and, thus, be relatively difficult to perceive and/or unnoticeable.

Furthermore, as depicted, a negative difference is present between 0.2 to 0.3 seconds. As described above, the third image frame 142C is displayed during that duration with a 60 Hz expected refresh rate, but a 10 Hz actual refresh rate. Thus, the pixel response correction undercompensated, thereby resulting in the average luminance of the display pixel during the third image frame 142C being less than the target luminance. However, due to the longer duration (e.g., 0.1 s), the difference resulting in the third image frame 142C may be relatively large and, thus, be relatively easier to perceive and/or notice. In other words, using the direct transition technique (e.g., transitioning directly from a higher refresh rate to a lower threshold refresh rate), may increase of perceptibility of visual artifacts in a transition image frame (e.g., third image frame 142C).

To help reduce likelihood of producing perceptible visual artifacts, the electronic display 12 may instead use a step-down transition technique. Specifically, the electronic display 12 may transition from a higher refresh rate (e.g., 60 Hz) to a lower threshold refresh rate (e.g., 10 Hz) using one or more step-down refresh rates. As will be described in more detail below, a step-down refresh rate may be a refresh rate between the higher refresh rate and the lower threshold refresh rate. Accordingly, difference between the higher refresh rate and the step-down refresh rate may be less than difference between the higher refresh rate and the lower threshold refresh rate. As such, difference between pixel response correction offsets determined using the higher refresh rate and the step-down refresh rate may be less than difference between pixel response correction offsets determined using the higher refresh and the lower refresh rate, which may facilitate reducing difference between perceived luminance and target luminance.

Figure 17:
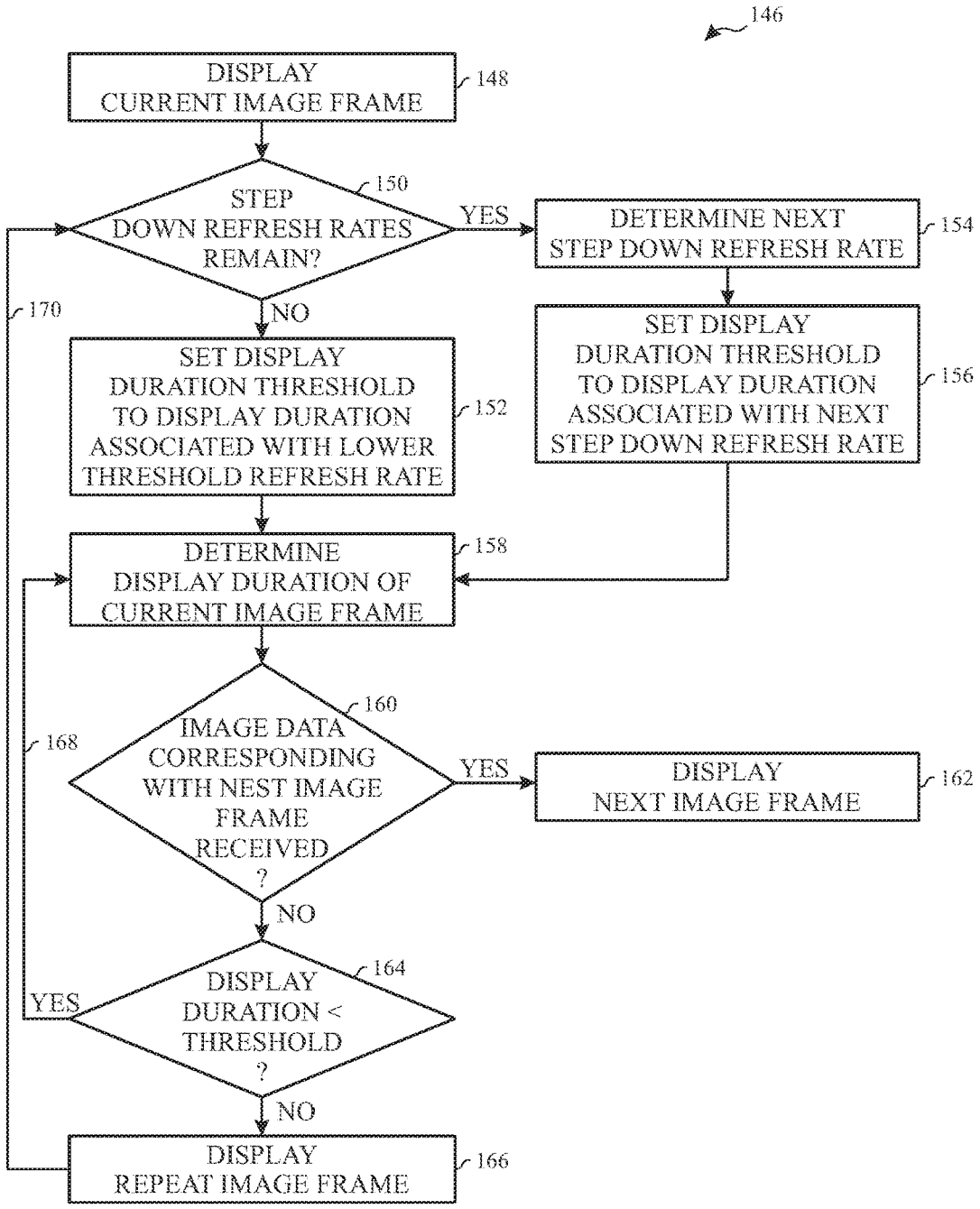
FIG. 17 is a flow diagram of a process for implementing a step-down transition technique, in accordance with an embodiment.

To help illustrate, one embodiment of a process 146 for operating an electronic display 12 using a step-down transition technique is described in FIG. 17. Generally, the process 146 includes displaying a current image frame (process block 148), determining whether step-down refresh rates remain (decision block 150), and setting a display duration threshold to display duration associated with a lower threshold refresh rate when no step-down refresh rates remain (process block 152). When step-down refresh rates remain, the process 146 includes determining a next step-down refresh rate (process block 154) and setting the display duration threshold to a display duration associated with the next step-down refresh rate (process block 156). Additionally, the process 146 includes determining display duration of the current image frame (process block 158), determining whether image data corresponding to a next image frame is received (decision block 160), and displaying the image frame when the corresponding image data is received (process block 162). When the corresponding image data is not yet received, the process 146 includes determining whether the display duration of the current image frame is less than the display duration threshold (decision block 164) and displaying a repeat image frame when the display duration of the current image frame not less than the display duration threshold (process block 166). In some embodiments, the process 146 may be implemented based on circuit connections (e.g., logic gates) formed in the display pipeline 36. Additionally or alternatively, the process 146 may be implemented by executing instructions stored in a tangible, non-transitory, computer-readable medium, such as the controller memory 52, using processing circuitry, such as the controller processor 50.

Accordingly, in some embodiments, the controller 42 may instruct the electronic display 12 to display a current image frame (process block 148). In some embodiments, the display driver 40 may display the current image frame by applying analog electrical signals to display pixels based on processed (e.g., pixel response corrected) image data.

Additionally, the controller 42 may instruct the display pipeline 36 to determine whether step-down refresh rates remain (decision block 150). In some embodiments, step-down refresh rates used for an electronic display 12 may be predetermined and stored, for example, in the frame buffer 46, the controller memory 52, and/or another tangible, non-transitory, computer-readable medium. Thus, in such embodiments, the display pipeline 36 may retrieve the step-down refresh rates and determine whether any step-down refresh rates remain between the expected refresh rate of the current image frame and a lower threshold refresh rate of the electronic display 12.

Additionally, in some embodiments, the step-down refresh rates may be determined based at least in part on characteristics (e.g., properties) of the electronic display 12 and/or target (e.g., desired) design parameters of the electronic display 12, such as target image display quality (e.g., perceptible visual artifact threshold) and/or target power consumption. As described above, power consumption of an electronic display 12 may be related to refresh rate used by the electronic display 12 to display image frames. For example, a higher refresh rate may increase power consumption while a lower refresh rate may decrease power consumption. Thus, increasing number of step-down refresh rates may reduce duration an electronic display 12 is at its lower threshold refresh rate and, thus, increase power consumption. On the other hand, decreasing number of step-down refresh rates may increase duration the electronic display 12 is at its lower threshold refresh rate and, thus, decrease power consumption. In other words, desire to reduce power consumption may push toward reducing number of step-down refresh rates However, the number of step-down refresh rates may also affect perceptibility of differences (e.g., variations) between perceived luminance and target luminance. For example, increasing number of step-down refresh rates may reduce difference between expected refresh rate and actual refresh rate of an image frame and, thus, reduce perceptibility of visual artifacts in the image frame and/or likelihood of perceptible visual artifacts in the image frame. On the other hand, decreasing number of step-down refresh rates may increase difference between the expected refresh rate and the actual refresh rate of the image frame and, thus, increase perceptibility of visual artifacts in the image frame and/or likelihood of perceptible visual artifacts in the image frame. In other words, desire to improve displayed image quality may push toward increasing number of step-down refresh rates.

Additionally, as described above, pixel response correction offsets may be applied to compensate for gradual decrease of the analog electrical signal stored in display pixels. However, the profile of the decrease may vary between different electronic displays 12. For example, display pixels of a first electronic display 12 may decrease at a faster rate and, thus, larger pixel response correction offsets may be applied to compensate. On the other hand, display pixels of a second electronic display 12 may decrease at a slower rate and, thus, smaller pixel response correction offset may be applied to compensate.

Thus, difference in magnitude of pixel response correction offsets applied for different expected refresh rates may be less for image frames displayed on the second electronic display 12 compared to the first electronic display 12. In other words, larger differences between expected refresh rate and actual refresh rate may be acceptable in the second electronic display 12 compared to the first electronic display 12. As such, this may enable the second electronic display 12 to use fewer step-down refresh rates compared to the first electronic display 12.

Accordingly, the step-down refresh rates used for an electronic display 12 may be determined by balancing the various factors. Moreover, since design parameters (e.g., target power consumption and/or target image quality) and/or characteristics of different electronic displays 12 may vary, the location (e.g., refresh rate) and/or number of step-down refresh rates may vary between the different electronic displays 12.

When step-down refresh rates remain, the controller 42 may instruct the display pipeline 36 to determine a next step-down refresh rate (process block 154). Specifically, the next step-down refresh rate may be the highest step-down refresh rate between the expected refresh rate of the current image frame and the lower threshold refresh rate. For example, when the expected refresh rate is of the current image frame is 60 Hz and the step-down refresh rates are 30 Hz and 15 Hz, the display pipeline 36 may determine that the next step-down refresh rate is 30 Hz. Additionally, when the expected refresh rate of the current image frame is 30 Hz, the display pipeline 36 may determine that the next step-down refresh rate is 15 Hz.

The controller 42 may also instruct the display pipeline 36 to set a display duration threshold to the display duration associated with the next step-down refresh rate (process block 156). For example, when the next step-down refresh rate is 30 Hz, the display pipeline 36 may set the display duration threshold to 33.33 ms. Additionally, when the next step-down refresh rate is 15 Hz, the display pipeline 36 may set the display duration threshold to 66.67 ms.

On the other hand, when no step-down refresh rates remain, the controller 42 may instruct the display pipeline to set the display duration threshold to the display duration associated with the lower threshold refresh rate of the electronic display (process block 152). For example, when the lower threshold refresh rate is 10 Hz, the display pipeline 36 may set the display duration threshold to 100 ms.

Additionally, the controller 42 may instruct the display pipeline 36 to determine display duration of the current image frame (process block 158). In some embodiments, the display pipeline 36 may use a timing mechanism (e.g., a counter, a clock, or a timer) to determine the display duration. For example, in some embodiments, the display pipeline 36 may start the time when the current image frame is initially displayed and the timing mechanism may periodically increment. In such embodiments, the display pipeline 36 may determine the display duration of the current image frame based at least in part on value of the timing mechanism.

While the current image frame is displayed, the controller 42 may instruct the display pipeline 36 to determine whether image data corresponding to a next image frame to be displayed is received (decision block 160). Additionally, when the image data corresponding to the next image frame is received, the controller 42 may instruct the electronic display 12 to display the next image frame (process block 162). Specifically, the electronic display 12 may overwrite the current image frame with the next image frame. In this manner, the electronic display 12 may immediately exit a step-down refresh rate and/or the lower threshold refresh rate.

When the image data corresponding to the next image frame is not yet received, the controller 42 may instruct the display pipeline 36 to determine whether the display duration of the current image frame less than the display duration threshold (decision block 164). Additionally, when the display duration is less than the display duration threshold, the controller 42 may instruct the display pipeline 36 to continue determining the display duration of the current image frame (arrow 168).

On the other hand, when the display duration is not less than the display duration threshold, the controller 42 may instruct the electronic display 12 to display a repeat image frame (process block 166). In some embodiments, the repeat image frame may be a repeat of the current image frame. Additionally, in some embodiments, the display pipeline 36 may set the expected refresh rate of the repeat image frame based at least in part on the actual refresh rate of the current image frame. For example, when the actual refresh rate of the current image frame is 30 Hz, the display pipeline 36 may set the expected refresh rate of the repeat image frame at 30 Hz. Additionally, when the actual refresh rate of the current image frame is 10 Hz, the display pipeline may set the expected refresh rate of the repeat image frame at 10 Hz.

In this manner, using the step-down transition technique, the electronic display 12 may gradually transition display of image frames from a higher refresh rate (e.g., 60 Hz) to a lower threshold refresh rate (10 Hz) using one or more step-down refresh rates. As described above, using one or more step-down refresh rates may facilitate reducing perceptibility of differences between perceived luminance and target luminance of a display pixel and, thus, perceptibility of visual artifacts and/or likelihood of perceptible visual artifacts.

Figure 18:
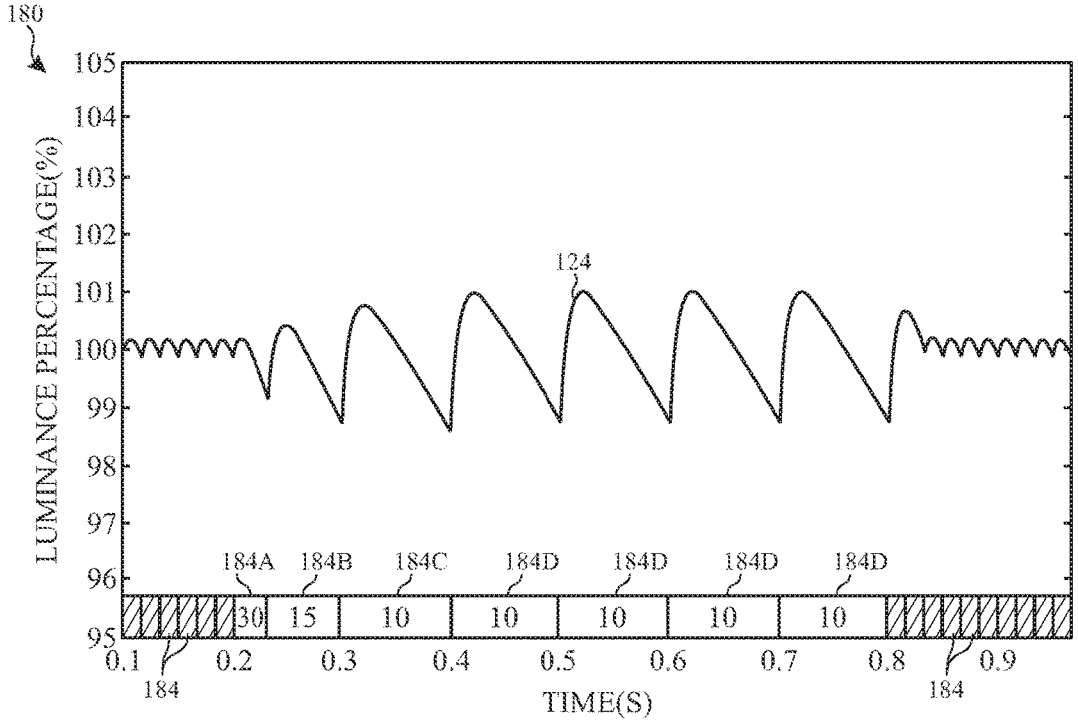
FIG. 18 is a plot of the luminance of a display pixel when using a step-down transition technique, in accordance with an embodiment.

To help illustrate, FIG. 18 depicts a plot 180 describing operation of an electronic display 12 using a step-down transition technique (e.g., transitioning from a higher refresh rate to a lower threshold refresh rate using one or more step-down refresh rates) when a display pipeline 36 receives the above-described image data stream. Specifically, the plot 180 includes a second luminance curve 182 that indicates luminance of a display pixel used to display image frames 184 based on the hypothetical image data stream relative to target luminance (e.g., 100% luminance). For the purpose of illustration, the electronic display 12 is described as using a 30 Hz step-down refresh rate and a 15 Hz step-down refresh rate. However, as described above, in other embodiments the location (e.g., frequency) and/or number of step-down refresh rates used may vary.

Using the step-down transition technique, operation of the electronic display 12 and the display pipeline 36 may be generally the same as using the direct transition technique between 0.1 to 0.2 seconds and after 0.4 seconds. Thus, as depicted, the second luminance curve 182 is generally the same as the first luminance curve 140 during those durations.

However, using the step-down transition technique, operation of the electronic display 12 and the display pipeline 36 may differ between 0.2 to 0.4 seconds. As described above, in the hypothetical image data steam, the display pipeline 36 temporarily ceases receiving image data for approximately 0.6 seconds. For example, the display pipeline 36 may cease receiving image data after receiving first image data corresponding to a first image frame 184A. Thus, the electronic display 12 may continue presentation of the visual representation of the first image frame 184A, for example, by displaying the first image frame 184A and/or one or more repeat image frames 184 (e.g., repeats of the first image frame 184A).

Using the direct transition technique, the electronic display 12 may attempt to reduce refresh rate to a next step-down refresh rate (e.g., highest step-down refresh rate between the expected refresh rate and the lower threshold refresh rate) when step-down refresh rates remain and to a lower threshold refresh rate when no more step-down refresh rates remain. For example, using a 30 Hz step-down refresh rate, the electronic display 12 may display an image frame 184 up to 33 ms (e.g., a display duration threshold). Additionally, using a 15 Hz step-down refresh rate, the electronic display 12 may display an image frame 184 up to 66.67 ms (e.g., a display duration threshold). Furthermore using a 10 Hz lower threshold refresh rate, the electronic display may display an image frame 184 up to 0.1 seconds (e.g., a display duration threshold). Accordingly, since the display pipeline 36 ceases receiving image data for approximately 0.6 seconds, the electronic display 12 may display the first image frame 184A using the 30 Hz step-down refresh rate, a first repeat image frame 184B using the 15 Hz step-down refresh rate, a second repeat image frame 184C using the 10 Hz lower threshold refresh rate, and subsequent repeat image frames 184D using the 10 Hz lower threshold refresh rate.

Before displaying the first image frame 184A, the display pipeline 36 may process the first image data, for example, by applying a pixel response correction offset to a grayscale value of the first image data based at least in part on expected refresh rate of the first image frame 184A. Since the directly previous image frame is displayed with a 60 Hz refresh rate, the display pipeline 36 may determine that the expected refresh rate of the first image frame 184A is 60 Hz and, thus, apply a 60 Hz pixel response correction offset to the first image data.

Based at least in part on the processed (e.g., pixel response corrected) first image data, the electronic display 12 may display the first image frame 184A by applying an analog electrical signal to the display pixel. As described by the second luminance curve 182, luminance of the display pixel spikes (e.g., increases rapidly) to approximately 0.2% above the target luminance (e.g., 100% luminance) when the first image frame 184A is initially displayed at 0.2 seconds and gradually decreases to approximately 0.8% below the target luminance by the end of the first image frame 184A. Since a 60 Hz pixel response correction offset is applied to the first image data, the pixel response correction offset is insufficient to compensate for the decrease in the stored analog electrical signal across the first image frame 184A. Thus, as depicted, area above the desire luminance is less than area below the target luminance, thereby resulting in average luminance of the display pixel being lower than the target luminance when the first image frame 184A is displayed.

Before displaying the first repeat image frame 184B, the display pipeline 36 may reprocess the first image data, for example, by applying a pixel response correction offset to grayscale values of the first image data based at least in part on an expected refresh rate of the first repeat image frame 184B. Since the directly previous image frame (e.g., first image frame 184A) is displayed with a 30 Hz refresh rate, the display pipeline 36 may determine that the expected refresh rate of the first repeat image frame 184B is 30 Hz and, thus, apply a 30 Hz pixel response correction offset to the first image data.

Based at least in part on the reprocessed (e.g., pixel response corrected) first image data, the electronic display 12 may display the first repeat image frame 184B by applying an analog electrical signal to the display pixel. Accordingly, as described by the second luminance curve 182, luminance of the display pixel spikes (e.g., increases rapidly) to approximately 0.5% above the target luminance (e.g., 100% luminance) when the first repeat image frame 184B is initially displayed and decreases to approximately 1.2% below the target luminance by the end of the first repeat image frame 184B. Thus, as depicted, area above the desire luminance is less than area below the target luminance, thereby resulting in average luminance of the display pixel being lower than the target luminance when the first repeat image frame 184B is displayed.

Before displaying the second repeat image frame 184C, the display pipeline 36 may reprocess the first image data, for example, by applying a pixel response correction offset to grayscale values of the first image data based at least in part on an expected refresh rate of the second repeat image frame 184C. Since the directly previous image frame (e.g., first repeat image frame 184B) is displayed with a 15 Hz refresh rate, the display pipeline 36 may determine that the expected refresh rate of the second repeat image frame 184C is 15 Hz and, thus, apply a 15 Hz pixel response correction offset to the first image data.

Based at least in part on the reprocessed (e.g., pixel response corrected) first image data, the electronic display 12 may display the second repeat image frame 184C by applying an analog electrical signal to the display pixel. Accordingly, as described by the second luminance curve 182, luminance of the display pixel spikes (e.g., increases rapidly) to approximately 0.8% above the target luminance (e.g., 100% luminance) when the second repeat image frame 184C is initially displayed and decreases to approximately 1.5% below the target luminance by the end of the second repeat image frame 184C. Thus, as depicted, area above the desire luminance is less than area below the target luminance, thereby resulting in average luminance of the display pixel being lower than the target luminance when the second repeat image frame 184C is displayed.

Accordingly, using the step-down transition technique, average luminance of the display pixel may vary from target luminance when the first image frame 184A, the first repeat image frame 184B, and the second repeat image frame 184C are displayed due to pixel response correction offsets being applied based on expected refresh rates different from actual refresh rates. However, perceptibility of the variations may be reduced compared to the direct transition technique due to smaller differences between the expected refresh rates and the actual refresh rates and/or spreading the variations over multiple image frames 184.

Figure 19:
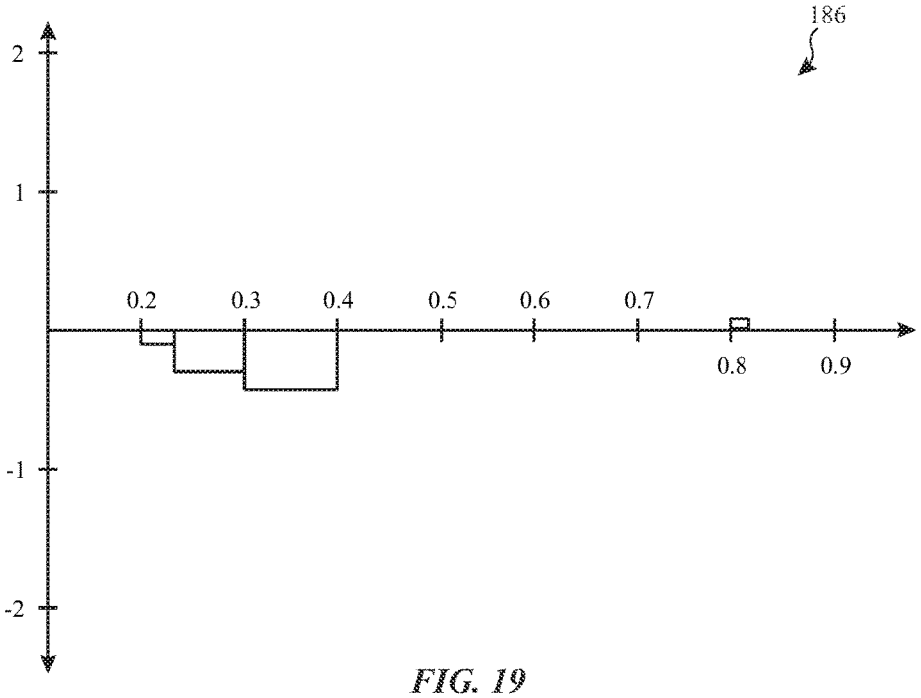
FIG. 19 is a plot of difference between average luminance and target luminance of the display pixel from FIG. 18, in accordance with an embodiment.

To help illustrate, FIG. 19 depicts a plot 186 that presents a graphical representation of difference (e.g., integral of second luminance curve 182 relative to 100% luminance) between target luminance (e.g., 100% luminance) and average luminance of the display pixel when displaying the image frames 184 using the step-down transition technique. As depicted, the difference is approximately zero between 0.1 to 0.2 seconds, between 0.4 to 0.8 seconds, and between approximately 0.817 seconds to 0.9 seconds. As described above, the image frames 184 displayed during those durations had expected refresh rates equal to their actual refresh rates. Thus, pixel response correction offsets applied to the corresponding image data was able to facilitate the average luminance being approximately equal to the target luminance.

Additionally, as depicted, similar to the direct transition technique, the positive difference is present between approximately 0.8 to 0.817 seconds. However, due to the short duration (e.g., 16.67 ms), the difference resulting may be relatively small and, thus, be relatively difficult to perceive and/or unnoticeable.

Furthermore, as depicted, a negative difference is present between 0.2 to 0.4 seconds. As described above, the first image frame 184A is displayed during that duration with a 60 Hz expected refresh rate, but a 30 Hz actual refresh rate. Additionally, the first repeat image frame 184B is displayed duration that duration with a 30 Hz expected refresh rate, but a 15 Hz actual refresh rate. Furthermore, the second repeat image frame 184C is displayed duration that duration with a 15 Hz expected refresh rate, but a 10 Hz actual refresh rate. Thus, the pixel response correction undercompensated, thereby resulting in the average luminance of the display pixel during the first image frame 184A, the first repeat image frame 184B, and the second repeat image frame 184C being less than the target luminance.

However, since difference between the expected refresh rates and the actual refresh rates decreases, magnitude of variations between the average luminance and the target luminance also decrease. For example, as depicted, magnitude of the variation produced in the first image frame 184A, the first repeat image frame 184B, and the second repeat image frame 184C by using the step-down transition technique may each be less than magnitude of the variation produced in the third image frame 142C by using the direct transition technique. In fact, sum of the variations produced in the first image frame 184A, the first repeat image frame 184B, and the second repeat image frame 184C may be less than magnitude of the variation produced in the third image frame 142C.

Moreover, since spread over multiple image frames, the variations produced in the first image frame 184A, the first repeat image frame 184B, and the second repeat image frame 184C by using the step-down transition technique may change gradually. For example, as depicted, magnitude of the variation produced in the first image frame 184A may be small, magnitude of the variation produced in the first repeat image frame 184B may be slightly larger, and magnitude of the variation produced in the second repeat image frame 184C may be still slightly larger. Comparatively, using the direct transition technique, magnitude of the variation produced in the third image frame 142C may change dramatically and, thus, be more likely to be perceived. In this manner, using a step-down transition technique may facilitate reducing likelihood of perceptible visual artifacts and/or perceptibility of any visual artifacts displayed.

Figure 20:
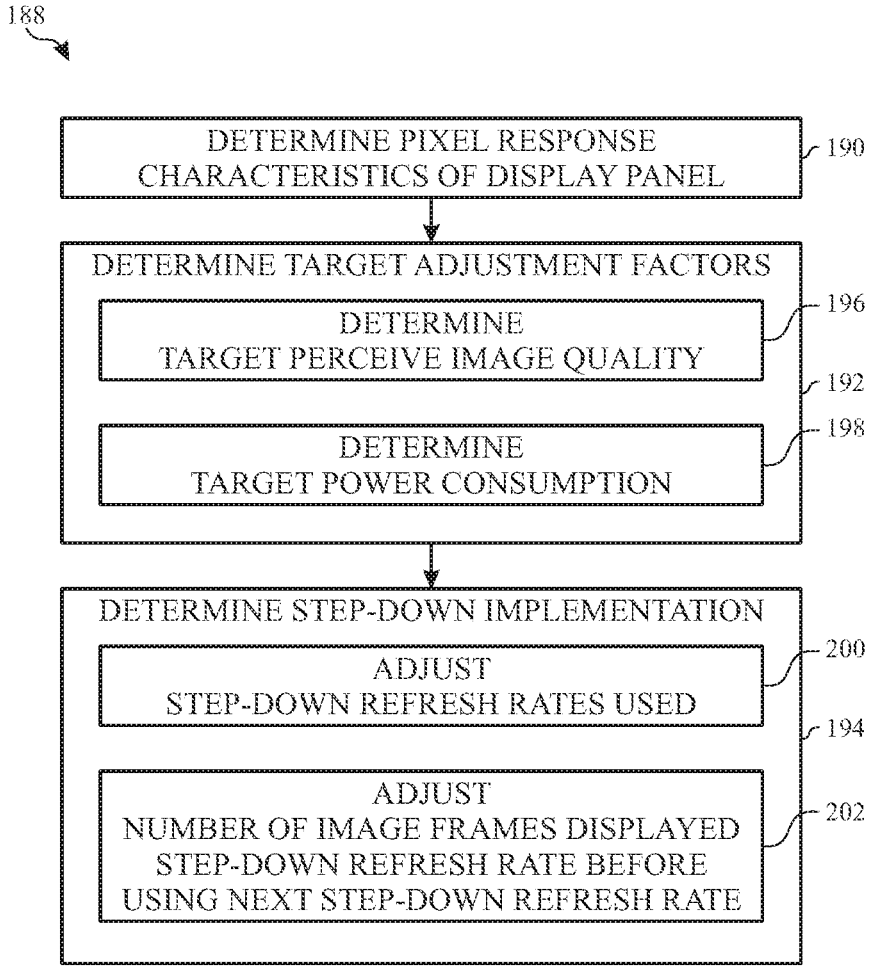
FIG. 20 is a flow diagram of a process for determining implementation of a step-down scheme, in accordance with an embodiment.

As described above, in some embodiments, implementation of the step-down scheme may be adjusted. To help illustrate, one embodiment of a process 188 for determining (e.g., adjusting) a step-down implementation scheme is described in FIG. 20. Generally, the process 188 includes determining pixel response characteristics of a display panel (process block 190), determining target adjustment factors (process block 192), and determining step-down implementation (process block 194). In some embodiments, the process 188 may be implemented based on circuit connections (e.g., logic gates) formed in the display pipeline 36. Additionally or alternatively, the process 188 may be implemented by executing instructions stored in a tangible, non-transitory, computer-readable medium, such as the controller memory 52, using processing circuitry, such as the controller processor 50.

Accordingly, in some embodiments, the controller 42 may determine pixel response characteristics of display pixels in an electronic display 12 (process block 188). In some embodiments, the pixel response characteristics may include amount input image data is adjusted to generate pixel response corrected image data over various refresh rates. Thus, in some embodiments, the controller 42 may determine the pixel response characteristics by analyzing the pixel response correction look-up-tables 48, for example, to determine variation in pixel response correction offsets applied for different expected refresh rates.

Additionally, the controller 42 may determine target adjustment factors (process block 196). In some embodiments, scheme of the step-down implementation may affect power consumption and/or perceived image quality. For example, increasing number of step-down refresh rates and/or reducing spacing between the step-down refresh rates may facilitate improving perceived image quality, but increase power consumption. On the other hand, reducing number of step-down refresh rates and/or spacing between the step-down refresh rates may facilitate reducing power consumption, but increase likelihood of perceivable visual artifacts—particularly in electronic displays 12 with worse pixel response characteristics (e.g., large voltage fluctuations during display of an image frame).

Thus, in some embodiments, determining the target adjustment factors may include determining a target perceived image quality (process block 196). In some embodiments, the controller 42 may determine the target perceived image quality automatically, for example, based at least in part on type of image frames to be displayed. Additionally or alternatively, the controller 42 may determine the target perceived image quality based at least in part on user inputs, for example, received via the input structures 14 and/or touch-sensing components of the electronic display 12.

Additionally, in some embodiments, determining the target adjust factors may include determining target power consumption (process block 198). In some embodiments, the controller 42 may determine the target power consumption automatically, for example, based at least in part remaining electrical energy stored in the power source 26. Additionally or alternatively, the controller 42 may determine the target power consumption based at least in part on user inputs, for example, received via the input structures 14 and/or touch-sensing components of the electronic display 12 that select a power mode (e.g., battery saver mode, normal battery mode, or high performance mode).

Based at least in part on the target adjustment factors and the display pixel response characteristics, the controller 42 may determine implementation of the step-down scheme (process block 194). In some embodiments, the controller 42 may adjust step-down refresh rates used in the step-down scheme (process block 200). For example, the controller 42 may increase number of step-down refresh rates and/or reduce spacing between step-down refresh rates to facilitate achieving improved perceived image quality.

Additionally or alternatively, in some embodiments the controller 42 may adjust number of image frames displayed at each step-down refresh rate before using the next step-down refresh rate (process block 202). In the previously described example, the next step-down refresh rate is used after one frame is displayed using each step-down refresh rate. However, in some embodiments, the controller 42 may increase or decrease number of image frames displayed at each step-down refresh rate before using the next step-down refresh rate. For example, the controller 42 may adjust the step-down implementation such that two image frames are displayed at each step-down refresh rate before moving to a next step-down refresh rate.

Ideally, the controller 42 may adjust the step-down scheme implementation to meet each of the target adjustment factors. However, in some instances, this may not be possible. Thus, in such instances, the controller 42 may balance meeting of the various target adjustment factors. For example, as battery power decreases, the controller 42 may weight meeting the target power consumption greater than meeting the target perceived image quality.

Accordingly, the technical effects of the present disclosure include improving displayed image quality of an electronic display, for example, by reducing likelihood of displaying perceptible visual artifacts and/or reducing perceptibility of displayed visual artifacts. In some embodiments, displayed image quality may be improved by implementing a step-down transition technique, which uses one or more step-down refresh rates to transition from a higher refresh rate (e.g., 60 Hz) to a lower (e.g., lower threshold) refresh rate (e.g., 10 Hz). In this manner, difference between expected fresh rates and actual refresh rates of image frames may be reduced, thereby facilitating a reduction in difference between perceived luminance and target luminance. Additionally, in some embodiments, displayed image quality may be improved by determining pixel response correction offsets based at least in part on luminance of display pixels at the end of a directly previous image frame. In this manner, the pixel response correction offsets may be adjusted to compensate, thereby facilitating a reduction in difference between perceived luminance and target luminance.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. An electronic device comprising:

an electronic display comprising a display pixel, wherein the electronic display is configured to display a first image frame directly after a previous image frame at least in part by applying a first analog electrical signal to the display pixel; and image processing circuitry configured to:

receive first image data corresponding to the first image frame after previous image data corresponding to the previous image frame, wherein the first image data comprises a first grayscale value configured to indicate target luminance of the display pixel;

determine a first predicted refresh rate of the first image frame based at least in part on a previous actual refresh rate of the previous image frame;

determine a first pixel response correction offset based at least in part on the first predicted refresh rate of the first image frame; and determine first processed image data at least in part by applying the first pixel response correction offset to the first grayscale value, wherein the first processed image data is configured to indicate magnitude of the first analog electrical signal expected to reduce difference between perceived luminance and the target luminance of the display pixel.

2. The electronic device of claim 1, wherein:

the image processing circuitry is configured to receive second image data corresponding to a second image frame a duration after the first image data; and the electronic display is configured to:

be capable of displaying image frames at a lower threshold refresh rate, a first step-down refresh rate greater than the lower threshold refresh rate, and the previous actual refresh rate of the previous image frame, wherein the previous actual refresh rate of the previous image frame is greater than the first step-down refresh rate;

display the first image frame at the first step-down refresh rate when the duration is not less than a first display duration threshold associated with the first step-down refresh rate; and display a first repeat of the first image frame directly after the first image frame when the duration is greater than the first display duration threshold.

3. The electronic device of claim 2, wherein, when the duration is greater than the first display duration threshold:

the electronic display is configured to display the first repeat directly after the first image frame at least in part by applying a second analog electrical signal to the display pixel; and the image processing circuitry is configured to:

determine a second predicted refresh rate of the first repeat of the first image frame based at least in part on a first actual refresh rate of the first image frame;

determine a second pixel response correction offset based at least in part on the second predicted refresh rate of the first repeat of the first image frame; and determine second processed image data at least in part by applying the second pixel response correction offset to the first grayscale value, wherein the second processed image data is configured to indicate magnitude of the second analog electrical signal expected reduce difference between the perceived luminance and the target luminance of the display pixel while the first repeat of the first image frame is displayed.

4. The electronic device of claim 3, wherein, to determine the second predicted refresh rate of the first repeat of the first image frame, the image processing circuitry is configured to:

determine a maximum total display duration that indicates total duration one or more image frames should be displayed based on the first image data;

determine a previous total display duration based at least in part on the first actual refresh rate of the first image frame; and determine the second predicted refresh rate based at least in part on difference between the maximum total display duration and the previous total display duration.

5. The electronic device of claim 2, wherein the electronic display is configured to:

be capable of displaying image frames at a second step-down refresh rate, wherein the second step-down refresh rate is greater than the lower threshold refresh rate and less than the first step-down refresh rate;

display the first repeat of the first image frame as a residue image frame when the duration minus the first display duration threshold is less than a second display duration threshold associated with the second step-down refresh rate; and when the duration minus the first display duration threshold is not less than the second display duration threshold:

display the first repeat of the first image frame at the second step-down refresh rate; and display a second repeat of the first image frame directly after the first repeat of the first image frame when the duration minus the first display duration threshold is greater than the second display duration threshold.

6. The electronic device of claim 2, wherein the electronic display is configured to display the first repeat of the first image frame at the lower threshold refresh rate when the duration minus the first display duration threshold is not less than a second display duration threshold associated with the lower threshold refresh rate.

7. The electronic device of claim 1, wherein the image processing circuitry is configured to:

determine luminance of the display pixel resulting from display of the previous image frame based at least in part on the previous actual refresh rate of the previous image frame, a previous predicted refresh rate of the previous image frame, magnitude of a previous analog electrical signal applied to the display pixel to display the previous image frame, polarity of the previous analog electrical signal, environmental conditions present when the previous image frame is displayed, expected charge accumulation in the display pixel, or any combination thereof; and determine the first pixel response correction offset based at least in part on the luminance of the display pixel resulting from display of the previous image frame.

8. The electronic device of claim 1, wherein the image processing circuitry is configured to:

determine expected charge accumulation in the display pixel resulting from display of the previous image frame based at least in part on actual display duration of the previous image frame;

determine expected polarity of the first analog electrical signal to be supplied to the display pixel to display the first image frame based at least in part on actual polarity of a previous analog electrical signal supplied to the display pixel to display the previous image frame; and determine the first predicted refresh rate of the first image frame to be displayed directly after the previous image frame based at least in part on polarity of the expected charge accumulation resulting from display of the previous image frame, the expected polarity of the first analog electrical signal to be supplied to the display pixel to display the first image frame, magnitude of the expected charge accumulation resulting from display of the previous image frame, and a charge accumulation threshold.

9. The electronic device of claim 1, wherein the electronic display comprises a display driver configured to apply the first analog electrical signal to the display pixel based at least in part on the first processed image data.

10. The electronic device of claim 1, wherein the image processing circuitry comprises a display pipeline implemented at least in part in a system-on-chip in the electronic device, a timing controller in the electronic display, or both.

11. The electronic device of claim 1, wherein the image processing circuitry is configured to:

receive the first image data corresponding to the first image frame from an image data source;

instruct the electronic display to display the first image frame based at least in part on the image data to overwrite the previous image frame;

determine a display duration threshold associated with a step-down refresh rate, wherein the step-down refresh rate is less than a previous actual refresh rate of the previous image frame and greater than a lower threshold refresh rate of the electronic display; and instruct the electronic display to display a repeat of the first image frame when a display duration of the first image frame is no longer less than the display duration threshold associated with the step-down refresh rate.

12. The electronic device of claim 1, wherein the image processing circuitry is configured to:

determine the first predicted refresh rate of the first image frame to be displayed by the electronic display directly after the previous image frame;

determine pixel response corrected image data based at least in part on the first predicted refresh rate of the first image frame and the first image data, wherein the pixel response corrected image data is expected to offset variations in pixel response of display pixels in the electronic display and the first processed image data comprises the pixel response corrected image data; and instruct the electronic display to display the first image frame a display duration up to a display duration threshold associated with a step-down refresh rate at least in part by applying the first analog electrical signal to the display pixel based at least in part on the pixel response corrected image data, wherein the step-down refresh rate is less than the first predicted refresh rate of the first image frame and greater than a lower threshold refresh rate of the electronic display.

13. A method of operating an electronic display, comprising:

receiving image data corresponding to an image frame from an image data source;

displaying the image frame at least in part by supplying a first analog electrical signal with a first voltage polarity to a display pixel of the electronic display based at least in part on the image data to overwrite a previous image frame;

determining a first display duration threshold associated with a first step-down refresh rate, wherein the first step-down refresh rate is less than an actual refresh rate of the previous image frame and greater than a lower threshold refresh rate of the electronic display; and displaying a first repeat of the image frame at least in part by supplying a second analog electrical signal with a second voltage polarity opposite the first voltage polarity to the display pixel in response to determining that a first display duration of the image frame is no longer less than the first display duration threshold associated with the first step-down refresh rate.

14. The method of claim 13, further comprising:

determining a second display duration threshold associated with a second step-down refresh rate, wherein the second step-down refresh rate is less than the first step-down refresh rate and greater than the lower threshold refresh rate; and displaying a second repeat of the image frame in response to determining that a second display duration of the first repeat of the image frame is no longer less than the second display duration threshold associated with the second step-down refresh rate.

15. The method of claim 13, wherein displaying the image frame comprises:

determining an actual display duration of the previous image frame;

determining luminance of the display pixel of the electronic display at an end of the previous image frame at least in part by:

determining difference between the actual display duration and an expected display duration of the previous image frame;

determining environmental conditions present during display of the previous image frame; or both;

determining pixel response corrected image data based at least in part on the actual display duration of the previous image frame and the luminance of the display pixel at the end of the previous image frame; and determining magnitude of a voltage to apply to the display pixel to display the image frame based at least in part on the pixel response corrected image data.

16. A tangible, non-transitory, computer-readable medium storing instructions executable by one or more processors of an electronic device, wherein the instructions comprise instructions to:

determine a first predicted refresh rate of a first image frame to be displayed by an electronic display based at least in part on a previous actual refresh rate of a directly previous image frame;

determine first pixel response corrected image data based at least in part on the first predicted refresh rate of the first image frame and input image data, wherein the first pixel response corrected image data is expected to offset variations in pixel response of display pixels in the electronic display; and instruct the electronic display to display the image frame a first display duration up to a first display duration threshold associated with a first step-down refresh rate at least in part by applying a first analog electrical signal to a display pixel based at least in part on the first pixel response corrected image data, wherein the first step-down refresh rate is less than the first expected refresh rate of the first image frame and greater than a lower threshold refresh rate of the electronic display.

17. The computer-readable medium of claim 16, further comprising instructions to, when the first display duration is no longer less than the first display duration threshold:

determine that a first actual refresh rate of the first image frame is equal to the first step-down refresh rate;

determine second pixel response corrected image data based at least in part on the first actual refresh rate of the first image frame and the input image data; and instruct the electronic display to repeat display of the first image frame up to a second display duration threshold at least in part by applying a second analog electrical signal to the display pixel based at least in part on the second pixel response corrected image data, wherein magnitude of the second analog electrical signal is different from magnitude of the first analog electrical signal.

18. The computer-readable medium of claim 17, wherein the second display duration threshold comprises:

duration image frames are displayed at the lower threshold refresh rate;

duration image frames are displayed at a second step-down refresh rate less than the first actual refresh rate of the first image frame and greater than the lower threshold refresh rate; or difference between a maximum total display duration and a previous total display duration.

19. The computer-readable medium of claim 16, wherein the instructions to determine the first pixel response corrected image data comprise instructions to:

determine luminance of the display pixel directly before display of the first image frame; and determine the first pixel response corrected image data based at least in part on the luminance of the display pixel directly before display of the first image frame.

20. The computer-readable medium of claim 19, wherein the instructions to determine the luminance of the display pixel directly before display of the image frame comprise instructions to:

determine difference between the previous actual refresh rate of the previous image frame and a previous predicted refresh rate of the previous image frame;

determine environmental conditions present during display of the previous image frame; and determine the luminance of the display pixel at an end of the previous image frame based at least in part on the environmental conditions and the difference between the previous actual refresh rate of the previous image frame and the previous expected refresh rate of the previous image frame.

* * * * *